US010308050B2

(12) United States Patent
Moriyama et al.

(10) Patent No.: US 10,308,050 B2
(45) Date of Patent: Jun. 4, 2019

(54) PRINTING APPARATUS

(71) Applicant: SEIKO EPSON CORPORATION, Tokyo (JP)

(72) Inventors: Ryuji Moriyama, Nagano (JP); Hiroyuki Maeda, Nagano (JP); Atsushi Nakazawa, Nagano (JP); Noritsuna Rokuhara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/421,626

(22) Filed: Feb. 1, 2017

(65) Prior Publication Data

US 2017/0232765 A1 Aug. 17, 2017

(30) Foreign Application Priority Data

Feb. 15, 2016 (JP) ..... 2016-026142

(51) Int. Cl.
*B41J 2/01* (2006.01)
*B41J 13/00* (2006.01)

(52) U.S. Cl.
CPC ..... *B41J 13/0009* (2013.01); *B41J 2/01* (2013.01)

(58) Field of Classification Search
CPC ..... B41J 11/0095; B41J 29/393; B41J 29/38; B41J 11/008; B41J 11/0065; B41J 2/01; B41J 11/003; B41J 13/0009; B41J 2/155; B41J 2/16585
USPC ..... 347/5, 13, 14, 16, 19, 104
See application file for complete search history.

(56) References Cited

U.S. PATENT DOCUMENTS

2013/0257973 A1* 10/2013 Tamura ..... B41J 11/42 347/19

FOREIGN PATENT DOCUMENTS

| | | |
|---|---|---|
| JP | 2001-287405 A | 10/2001 |
| JP | 2011-194612 A | 10/2011 |
| JP | 2012-076904 A | 4/2012 |
| JP | 2014-018987 A | 2/2014 |

* cited by examiner

*Primary Examiner* — Bradley W Thies

(57) ABSTRACT

A printing apparatus includes a transport portion that transports a medium, a printing head that performs printing on the medium, a medium detection device that is arranged upstream of the printing head in a transport direction of the medium and detects a side edge of the medium in a width direction intersecting with the transport direction, and a control unit that controls the transport portion, the printing head, and the medium detection device.

14 Claims, 17 Drawing Sheets

PRINTING APPARATUS

BACKGROUND

1. Technical Field

The present invention relates to a printing apparatus that includes a transport portion transporting a medium such as paper, a printing head performing printing on the transported medium, and a medium detection device capable of detecting a side edge of the medium in a width direction intersecting with a transport direction.

2. Related Art

In the related art, a printing apparatus that has a transport portion transporting a medium such as paper and a printing head performing printing on the medium has been widely known as one example of this type of printing apparatus (for example, JP-A-2001-287405 and the like).

For example, in JP-A-2001-287405, disclosed is a serial type printing apparatus (serial printer) that includes a paper width detection device (one example of a medium detection device) detecting the width of paper in a position upstream of a printing unit in the transport direction of paper (one example of a medium). This printing apparatus includes a carriage and two sensors (a right side detector and a left side detector). The carriage includes a printing head that moves by driving of a motor in a paper width direction (main-scanning direction) orthogonal with respect to the transport direction of the paper and performs printing. The two sensors are disposed in a position upstream of the printing head of the carriage in the transport direction. While the carriage moves in the paper width direction, the right side detector detects the right side edge of the paper, and the left side detector detects the left side edge of the paper.

The paper width detection device disclosed in JP-A-2001-287405 is disposed in the carriage that is movable in the main-scanning direction in order to perform printing in the serial printing type printing apparatus. Thus, printing apparatuses that do not include a printing carriage, for example, a line printing type printing apparatus (line printer), cannot employ a configuration in which a sensor is disposed in the printing carriage. In addition, in the case of separately attaching a device that can detect both side edges of a medium having the maximum width predetermined in the printing apparatus, a problem arises in that the size of the printing apparatus in the width direction may be increased. This type of problem is common to a serial printing type printing apparatuses as well in a case where a configuration in which a sensor is included in the printing carriage as in JP-A-2001-287405 is desired to be avoided in order to prevent a decrease in detection accuracy due to a sensor being stained with ink.

SUMMARY

An advantage of some aspects of the invention is to provide a printing apparatus that can detect both side edges of a medium in the width direction independently of printing types such as whether a printing head is movable or fixed, and that can have an apparatus size dimension in the width direction reduced to be comparatively small.

Hereinafter, means for solving the problems and operation effects thereof will be described.

According to an aspect of the invention, there is provided a printing apparatus including a transport portion that transports a medium, a printing head that performs printing on the medium, a medium detection device that is arranged upstream of the printing head in a transport direction of the medium and detects a side edge of the medium in a width direction intersecting with the transport direction, and a control unit that controls the transport portion, the printing head, and the medium detection device, in which the medium detection device includes a carriage that is movable in the width direction independently of the printing head in a position upstream of the printing head in the transport direction, two sensors that are disposed in different positions in the width direction in the carriage, and a source of motive power that moves the carriage, and the control unit renders the sensor to detect a side edge of the medium in the width direction by controlling the source of motive power to move the carriage.

According to this configuration, the two sensors are arranged in different positions in the width direction in the carriage of the medium detection device. Thus, using the two sensors for different uses when a side edge of the medium in the width direction is detected decreases the amount of movement of the carriage when a side edge is detected. Accordingly, both side edges of the medium in the width direction can be detected independently of printing types such as whether the printing head is movable or fixed, and the size dimension of the printing apparatus in the width direction can be reduced to be comparatively short even though the medium detection device is disposed.

In the printing apparatus, it is preferable that the carriage be disposed to be movable in the width direction in a position on the opposite side of a transport path of the medium transported by the transport portion from the printing head side, and the two sensors be optical sensors that irradiate the medium with light from a position on the opposite side of the transport path from the printing head side.

In this case, the carriage moves in the width direction in a position on the opposite side of the transport path of the medium from the printing head side, and thereby the two sensors configured of optical sensors irradiate the medium with light from a position on the opposite side of the transport path from the printing head side, and a side edge of the medium is detected. Since the two sensors move in a position on the opposite side of the medium from the printing head, ink from the printing head is unlikely to cling compared with a case where the two sensors are arranged on the same side of the medium as the printing head. Thus, a decrease in the accuracy of detection of the sensor due to staining with ink is easily avoided.

In the printing apparatus, it is preferable that the medium detection device include a casing that accommodates the carriage and the sensor, the casing include a medium support unit that supports the medium transported along the transport path, and the medium support unit include a window portion that is capable of transmitting light from the two sensors.

In this case, the medium support unit that includes the window portion capable of transmitting light from the sensor is disposed in the casing of the medium detection device between the medium transported along the transport path and a moving path of the sensor. Thus, the sensor can be protected from dust such as paper dust from the medium, ink mist from the printing head, and the like, and a side edge of the medium can be detected by the sensor through the window portion. In addition, since the window portion constitutes a part of the medium support unit, the distance between the sensor and the medium can be maintained approximately constantly. From this point as well, the accuracy of detection of the sensor can be highly maintained.

In the printing apparatus, it is preferable that the window portion be disposed in the medium support unit in plural numbers in the width direction.

In this case, the window portion is arranged in plural numbers in the width direction in a part of the medium support unit corresponding to a moving area of the sensor. Thus, comparatively high strength can be secured for the medium support unit compared with a configuration in which one long window portion is disposed across the moving area.

In the printing apparatus, it is preferable that a plurality of the window portions be disposed in a position where the two sensors are capable of detecting both side edges of the medium having the minimum width to the maximum width through the different window portions.

In this case, both side edges of the medium having the minimum width to the maximum width can be detected by the two sensors through different window portions. For example, both side edges of the medium having the minimum width to the maximum width can be continuously detected.

In the printing apparatus, it is preferable that a source of motive power of the medium detection device be a stepping motor.

In this case, since the source of motive power is a stepping motor, an encoder and the like required in the case of using a direct current motor (DC motor) is not required. Thus, the number of components of the medium detection device can be reduced to be small compared with the case of using a direct current motor. For example, it is easy to realize a small device size for the medium detection device.

In the printing apparatus, it is preferable that given that the width direction in which the carriage is movable is a left-right direction, in a case where the medium is a medium having the maximum width, when the carriage is in a left side end position in a movable range, the right side sensor of the two sensors sense the medium having the maximum width, and the left side sensor do not sense the medium having the maximum width, and meanwhile, when the carriage is in a right side end position in the movable range, the left side sensor of the two sensors sense the medium having the maximum width, and the right side sensor do not sense the medium having the maximum width.

In this case, when the medium has the maximum width, only the left side sensor is separated to the outside from the medium in the width direction when the carriage is in the left side end position, and only the right side sensor is separated to the outside from the medium in the width direction when the carriage is in the right side end position. That is, since the movable range of the carriage between the left and right end positions is relatively shorter than the width of the medium having the maximum width, the size dimension in the width direction of the printing apparatus in which the medium detection device is disposed is reduced to be comparatively short. In addition, in a case where the medium is a medium having the maximum width, both side edges of the medium having the maximum width can be detected by detecting the left side edge of the medium by using the left side sensor and detecting the right side edge of the medium by using the right side sensor.

In the printing apparatus, it is preferable that in a case where the width direction in which the carriage moves is a left-right direction, the control unit control the source of motive power to move the carriage in the width direction and thereby render the left side sensor to detect the left side edge of the medium and render the right side sensor to detect the right side edge of the medium.

In this case, the left side edge of the medium is detected by the left side sensor, and the right side edge of the medium is detected by the right side sensor. Accordingly, the distance of movement required for the carriage when both side edges of the medium in the width direction are detected is relatively short. Thus, the size dimension of the medium detection device in the width direction can be relatively small. For example, the size dimension of the printing apparatus in the width direction being relatively increased can be avoided even though the medium detection device is disposed, and the amount of time required for acquiring medium information related to the width direction of the medium can be reduced to be relatively small.

It is preferable that the printing apparatus further include a width information acquiring unit that acquires width information of the medium, in which the control unit, in a case where the width of the medium based on the width information is longer than a set width, controls the source of motive power in such a manner that the left side sensor detects the left side edge of the medium and that the right side sensor detects the right side edge of the medium.

In this case, in a case where the width based on the width information is longer than the set width, the left side edge of the medium is detected by the left side sensor, and the right side edge of the medium is detected by the right side sensor. Accordingly, the distance of movement required for the carriage when both side edges of the medium are detected is relatively short. Consequently, the size dimension of the medium detection device in the width direction can be small, and the amount of time required for acquiring the medium information can be reduced to be relatively small.

In the printing apparatus, it is preferable that the sensor be a light reflective type sensor, and a medium guide member that guides the medium along the transport path be arranged in a position facing a moving path of the sensor with the transport path of the medium transported by the transport portion interposed between the position and the moving path of the sensor, and a part of the medium guide member facing the moving path of the sensor be a light reflective surface.

In this case, a part of the medium guide member facing the moving path of the sensor is a light reflective surface. Thus, since a member dedicated for a light reflective surface is not required to be separately disposed, the medium guiding structure of the transport portion can be configured to be comparatively compact.

In the printing apparatus, it is preferable that the medium guide member be made of metal.

In this case, the light reflective surface can be comparatively simply formed by performing processing such as polishing or plating on a part of the medium guide member configured of metal that faces the moving path of the sensor.

In the printing apparatus, it is preferable that the control unit, when the transport portion does not transport the medium, regard the sensor as being normal if a detected signal of the sensor has a detected value when the medium is not present, and regard the sensor as failing if the detected signal has a detected value when the medium is present.

In this case, if, when the medium is not transported, the sensor does not receive reflective light from the light reflective surface and has a detected value when the medium is present, the sensor is regarded as failing. Accordingly, a problem that a wrong side edge of the medium based on a detected signal of the failing sensor is detected can be avoided to the greatest possible extent.

In the printing apparatus, it is preferable that the control unit, in a case where one of the two sensors fails, detect both side edges of the medium by using the other sensor.

In this case, since both side edges of the medium are detected by the other sensor in a case where one sensor fails, both side edge positions of the medium can be acquired even if one sensor fails.

It is preferable that the printing apparatus further include a width information acquiring unit that acquires the width information of the medium, in which the control unit, in a case where one sensor of the two sensors fails, detects both side edges of the medium by using the other sensor if the width of the medium based on the width information is less than or equal to the set width.

In this case, in a case where one sensor fails, both side edges of the medium are detected by the other sensor if the width of the medium based on the width information is less than or equal to the set width. Accordingly, even if one sensor fails, both side edge positions of a medium having a width less than or equal to the set width can be acquired.

In the printing apparatus, it is preferable that the control unit, in a case where one sensor of the two sensors fails, if the width of the medium based on the width information is greater than the set width, detect one side edge of both side edges of the medium by using the other sensor and estimate the position of the other side edge based on the result of detection of the one side edge and the width information.

In this case, in a case where one sensor fails, if the width of the medium based on the width information is greater than the set width, one side edge of both side edges of the medium is detected by the other sensor, and the position of the other side edge is estimated based on the result of detection of the one side edge and the width information. Accordingly, even for a medium having a width that is great to the extent that both side edges cannot be detected by the other sensor when one sensor fails, both side edge positions thereof can be acquired.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of a printing apparatus will be described with reference to the drawings.

Figure 1:
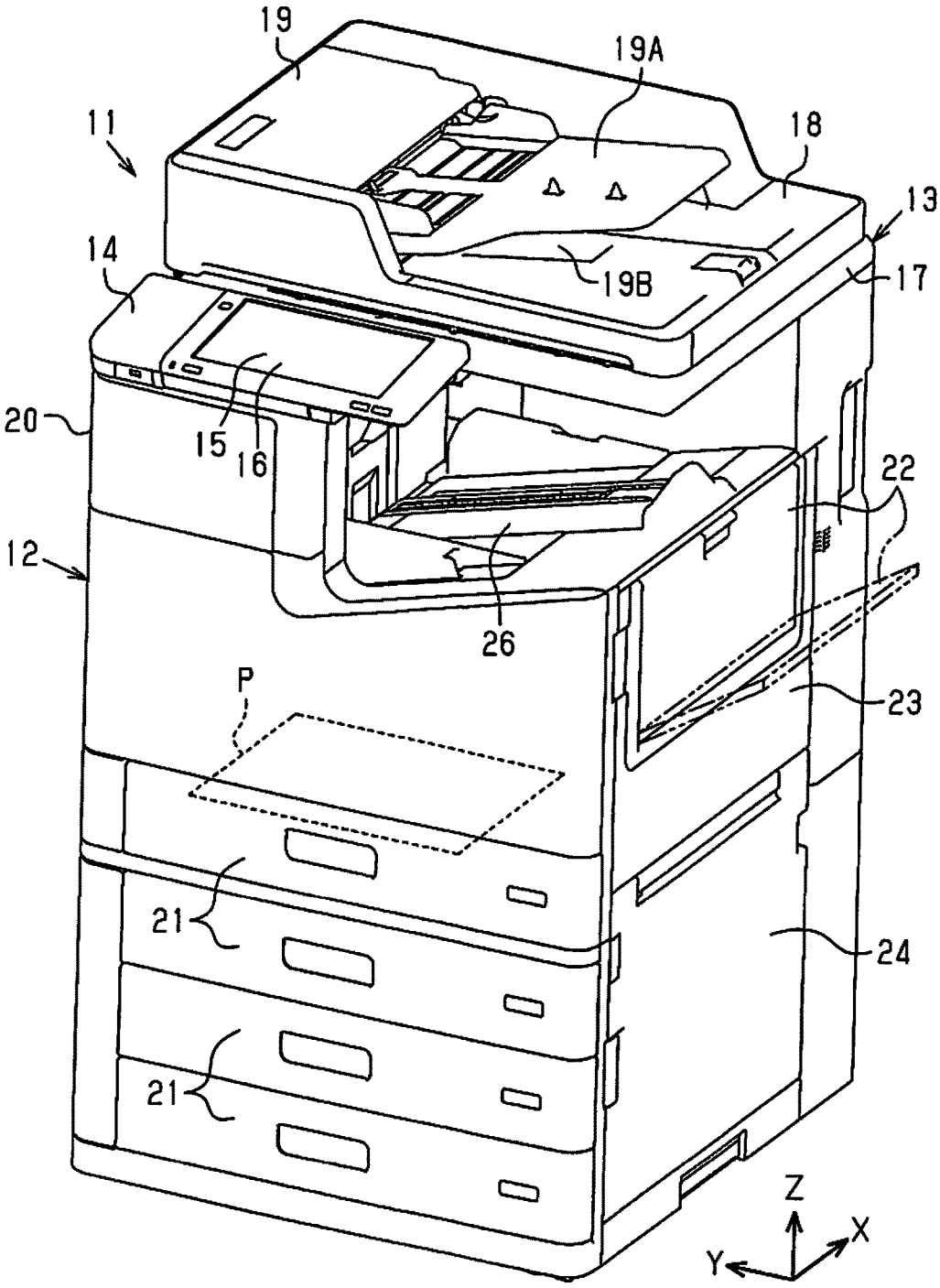
FIG. 1 is a perspective view illustrating a printing apparatus in one embodiment.

As illustrated in FIG. 1, a printing apparatus 11 is configured of a multifunction peripheral that includes a printer unit 12 and a scanner unit 13 and, as a whole, has a shape of an approximately rectangular parallelepiped which is long in a vertical direction Z. The printer unit 12 has a printing function of performing printing on a medium P such as paper. The scanner unit 13 is arranged on the upper side of the printer unit 12. An operation panel 14 is disposed in a position adjacent to (in FIG. 1, in front of) the scanner unit 13 in the upper surface portion of the printer unit 12. The operation panel 14 includes a display unit 15 that has, for example, a touch panel function. In the present example, a touch panel constitutes one example of an operation unit 16. The operation unit 16 may be an operation switch.

As illustrated in FIG. 1, the scanner unit 13 includes a scanner main body portion 17 and a document stand cover 18. The scanner main body portion 17 has an upper surface configured as a document stand not illustrated. The document stand cover 18 is disposed to be openable and closable with respect to the upper surface (document stand glass surface) of the scanner main body portion 17. An automatic document feed unit 19 (auto document feeder (ADF)) is mounted on the upper portion of the document stand cover 18.

The scanner unit 13 includes a reading unit, not illustrated, that reads a document which is set on document stand glass, not illustrated, by opening the document stand cover 18. The automatic document feed unit 19 feeds a plural sheets of documents set on a mount 19A one sheet at a time in order, and documents after scanned by the reading unit are discharged onto a stack portion 19B in order. The printing apparatus 11 configured as above includes a main body 20 and the document stand cover 18. The main body 20 has a shape of an approximately rectangular parallelepiped and includes the above document stand and the operation panel 14 in the upper surface portion thereof.

As illustrated in FIG. 1, in the lower portion of the printer unit 12, a cassette 21 that can accommodate a plural sheets of the medium P mounted in a stack is inserted in the main body 20 in plural numbers in the up-down direction to be insertable and withdrawable from the front. In addition, a feed tray 22 is disposed to be openable and closable about the lower end thereof in one side portion of the main body 20. The feed tray 22 can be opened as illustrated by a double-dot chain line in FIG. 1, and on the feed tray 22, the medium P on which printing is to be performed can be set. In addition, in one side portion of the main body 20, a cover 23 for maintenance that includes the feed tray 22 and a cover 24 for maintenance that is arranged on the lower side of the cover 23 are disposed to be horizontally openable and closable about one side end thereof. In the present embodiment, each of the cassette 21 and the feed tray 22 constitutes one example of a medium mount unit. The feed tray 22 may be a manual feed tray in which only one sheet of the medium P can be set, or may be a configuration equipped with a hopper function in which a plurality of media can be set in a stack and that can automatically feed one sheet at a time.

A part of the printer unit 12 on the upper side of the cassette 21 is configured as a printing mechanism unit 25 (refer to FIG. 2) that performs printing on the medium P fed from the cassette 21 or the feed tray 22. A stacker unit 26 to which a medium after printing is discharged is disposed between the printer unit 12 and the scanner main body portion 17.

Figure 2:
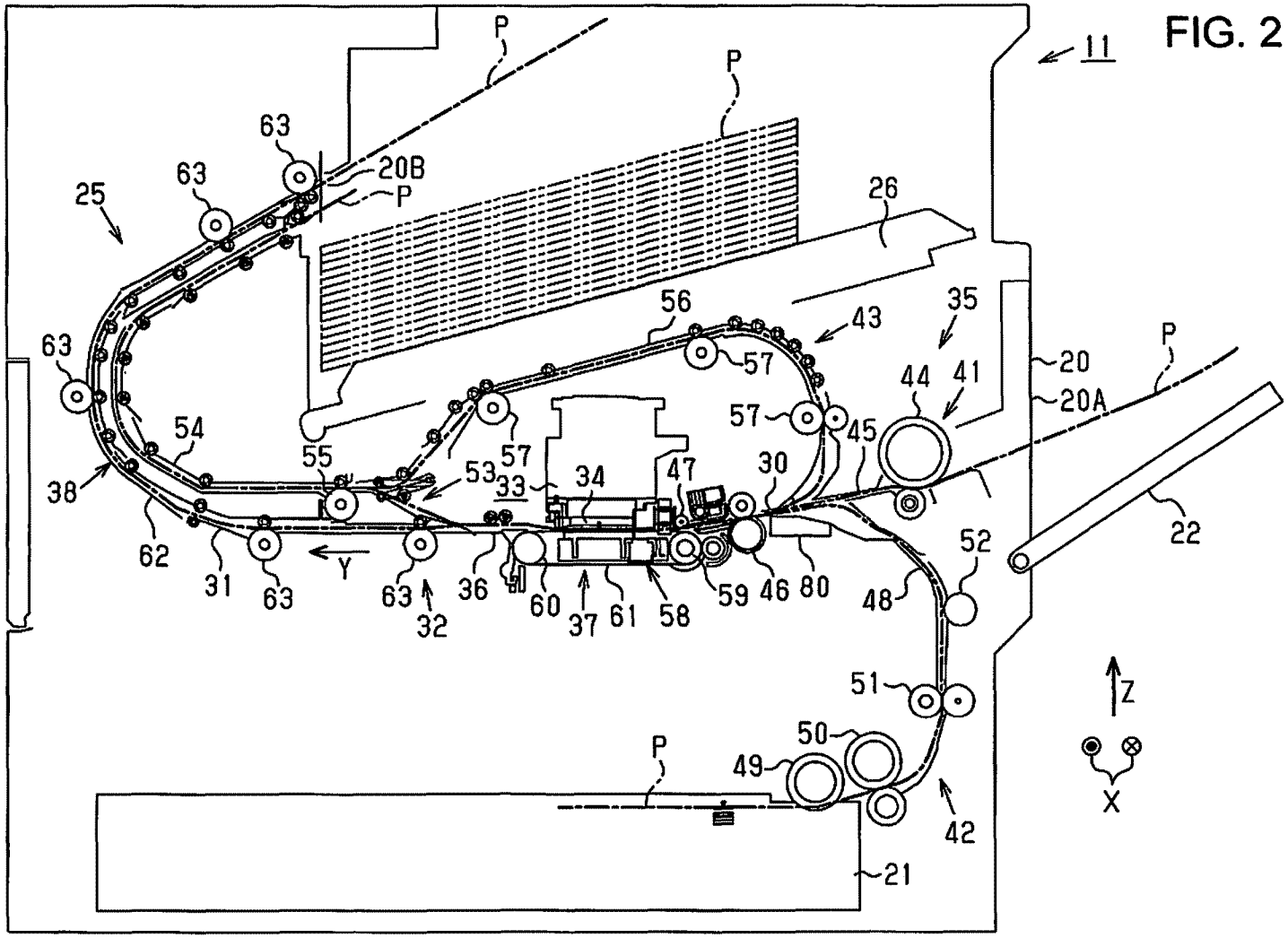
FIG. 2 is a schematic sectional view of the printing apparatus.

Next, a detailed configuration of the printer unit 12 will be described with reference to FIG. 2. In FIG. 2, only the uppermost cassette 21 is illustrated, and the others are not illustrated. In addition, the direction in which the medium P is transported when printing is performed by a printing head 34 is set as a transport direction Y, and the direction that intersects with (particularly, orthogonal with respect to) the transport direction Y is set as a width direction X.

As illustrated in FIG. 2, the above printing mechanism unit 25 is disposed in the main body 20 of the printing apparatus 11 of the present embodiment. A transport unit 32 and a printing unit 33 are disposed in the printing mechanism unit 25. The transport unit 32, as one example of a transport portion, transports the medium P along a transport path 31. The printing unit 33 includes the printing head 34 that performs printing on the medium P in transport.

The printing head 34 employs an ink jet type that discharges ink. The printing head 34 is configured of a line head of a long shape that extends slightly longer than the width of the medium P having the maximum width in the width direction X which is orthogonal with respect to the page of FIG. 1, and the printing head 34 is of a fixed type that is fixed to a predetermined position so that movement in the width direction X is not allowed.

The present embodiment employs a line printing type in which printing is performed in the shape of a line by discharging, by the printing head 34 configured of a fixed type line head, ink drops at the same time to the medium P in transport within an area extending in the width direction X. Ink that is discharged from the printing head 34 clings to the medium P, and thereby an image, a document, or the like is printed on the medium P. The present embodiment may also employ a serial printing type in which the printing unit 33 includes a printing carriage movable in the width direction X, the printing head 34 disposed in the printing carriage is of a moving type moving in the width direction X (main-scanning direction) along with the printing carriage, and a transport operation for the medium P and a printing operation by the printing head 34 are alternately performed.

As illustrated in FIG. 2, the transport unit 32 includes a feed mechanism unit 35, a transport mechanism unit 37, and a discharge mechanism unit 38. The feed mechanism unit 35 feeds the medium P. The transport mechanism unit 37 transports the medium P along the transport path 36 when the printing unit 33 performs printing. The discharge mechanism unit 38 transports the medium P after printing along a discharge path 62 and discharges the medium P to the stacker unit 26.

The feed mechanism unit 35 includes a first feed unit 41, a second feed unit 42, and a third feed unit 43. The first feed unit 41 has the feed tray 22 as a feed source. The second feed unit 42 has the cassette 21 as a feed source. The third feed unit 43 feeds the medium P, after printing is performed on a single side thereof at the time of double-sided printing, again to the transport path 36. The first feed unit 41 feeds, to the transport mechanism unit 37 along a first feed path 45 by rotation of a first feed roller pair 44, the medium P that is set on the feed tray 22 and has the leading edge portion thereof inserted from an insertion port 20A. The cover 23 (refer to FIG. 1 and FIG. 3) that includes the feed tray 22 is disposed to be openable and closable in a position upstream of the printing head 34 of the main body 20 in the transport direction Y.

The second feed unit 42 feeds the medium P from the cassette 21 to a second feed path 48. The second feed unit 42 includes a pickup roller 49, a separating roller pair 50, a second feed roller pair 51, and a passive roller 52. The pickup roller 49 withdraws the uppermost medium P in the cassette 21. The separating roller pair 50 separates one sheet from the withdrawn medium P. The second feed roller pair 51 and the passive roller 52 feed the separated one sheet of the medium P.

As illustrated in FIG. 2, the transport mechanism unit 37 includes a transport roller pair 46 and a belt transport mechanism 58. The transport roller pair 46 is arranged in a position slightly downstream of the location where the first to third feed units 41 to 43 are joined in the transport direction Y. The belt transport mechanism 58 is arranged in a position facing the printing head 34. The leading edge of the medium P abuts the stopped transport roller pair 46, and thereby the medium P is skewed during feeding, and the medium P after skewed is transported to the transport path 36 by rotation of the transport roller pair 46.

The belt transport mechanism 58 includes a pair of rollers 59 and 60 and a transport belt 61 that is wound on the pair of rollers 59 and 60. In addition, a transport passive roller 47 that is driven in contact with the transport belt 61 is arranged in a position above the roller 59 of the belt transport mechanism 58.

The belt transport mechanism 58 employs an electrostatic attraction type that attracts the medium P to the surface of the charged transport belt 61 by electrostatic force. The printing head 34 discharges ink toward the medium P that is transported at a constant speed by the belt transport mechanism 58 with a constant gap maintained with the printing head 34, and thereby an image, a document, or the like is printed on the medium P.

The third feed unit 43, at the time of double-sided printing, performs refeeding that turns over the medium P after printing is performed on one side (single side) thereof and guides the medium P again to the transport mechanism unit 37. The medium P discharged from the transport mechanism unit 37 after printing is performed on one side thereof is guided to a branch transport path 54 by a branch mechanism 53 and is guided, by reverse rotation of the transport roller pair 55 after forward rotation thereof, to an inversion feed path 56 that is positioned above the printing unit 33 in FIG. 2. The medium P is fed along the inversion feed path 56 by rotation of a plurality of inversion transport roller pairs 57 and is inverted and joins the first feed path 45 and the second feed path 48. Then, the medium P is guided again to the transport mechanism unit 37, and the printing head 34 performs printing on the other side of the inverted medium P on which printing is not performed yet, and thereby double-sided printing is performed.

The discharge mechanism unit 38 discharges the medium P on which printing is ended from a medium discharge port 20B onto the stacker unit 26 as illustrated by a double-dot chain line in FIG. 2, by rotation of a plurality of discharge roller pairs 63 arranged along the discharge path 62. The discharged medium P after printing is stacked on the stacker unit 26. A transport path 30 transports the medium P from the cassette 21 and the feed tray 22 along a path passing through a position in which the printing head 34 can perform printing.

As illustrated in FIG. 2, a medium detection device 80 is arranged slightly upstream of the transport roller pair 46 that is positioned upstream of the printing head 34 in the transport direction Y. The medium detection device 80 is positioned on the lower side of a position near a joint portion of the first feed path 45 and the second feed path 48 and near a joint portion of the transport path 30 and the inversion feed path 56. The medium detection device 80 detects a side edge of the medium P fed by the first feed unit 41 and the second feed unit 42, the side edge being in the width direction X that intersects with (particularly, orthogonal with respect to) the transport direction Y. Medium information that relates to a width and includes at least one of a side edge position of the medium P in the width direction X, a medium width (medium size), and a printing area in the width direction X is acquired from side edge information of the medium P detected by the medium detection device 80.

Figure 5:
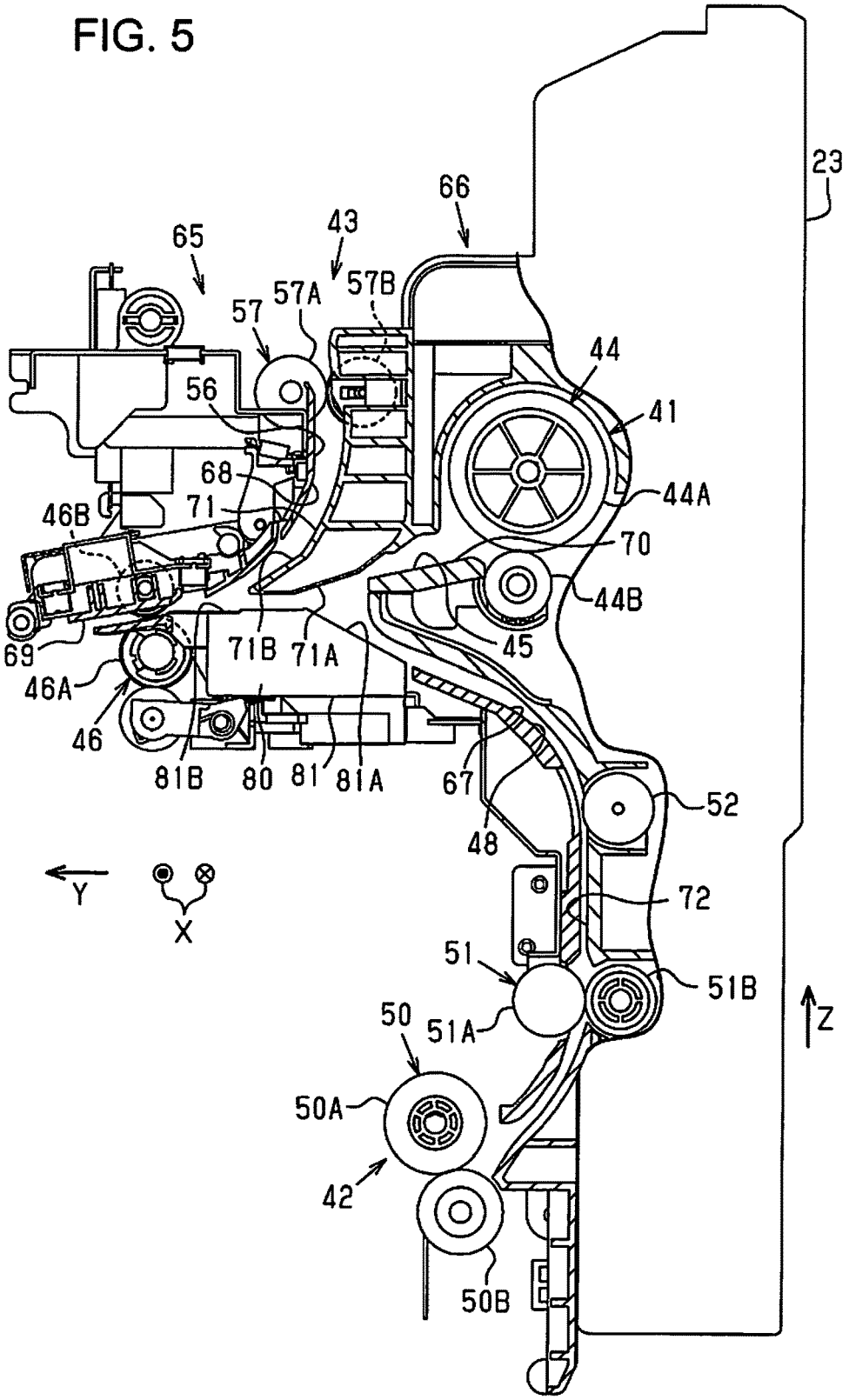
FIG. 5 is a side sectional view illustrating a feed mechanism.
Figure 6:
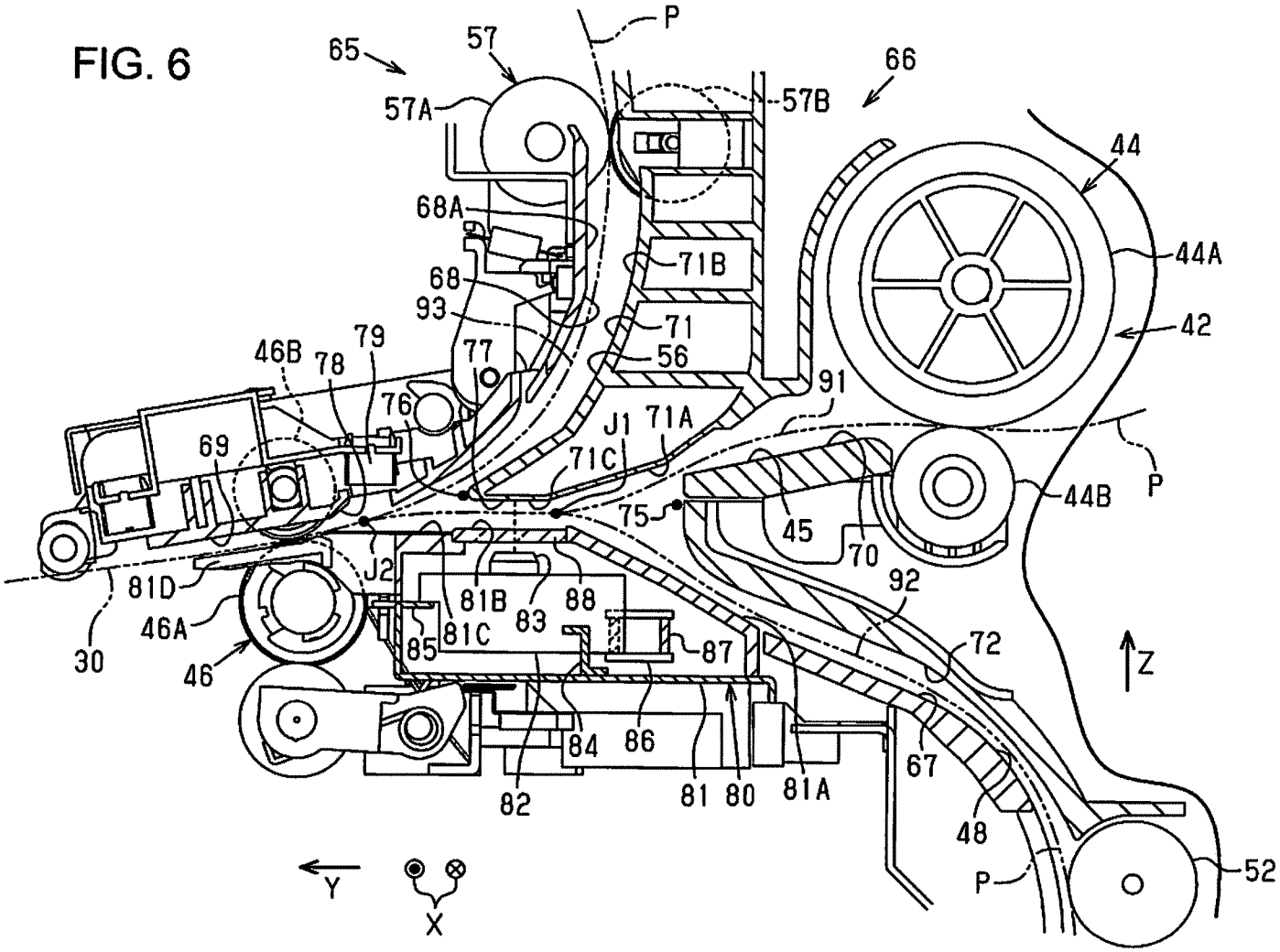
FIG. 6 is a side sectional view illustrating a part of the feed mechanism.

Next, a configuration of a part of the feed mechanism unit 35 that includes surroundings of the medium detection device 80 will be described with reference to FIG. 3 to FIG. 7. FIG. 5 and FIG. 6 illustrate the cover 23 that is closed, and FIG. 7 illustrates the cover 23 that is opened.

Figure 3:
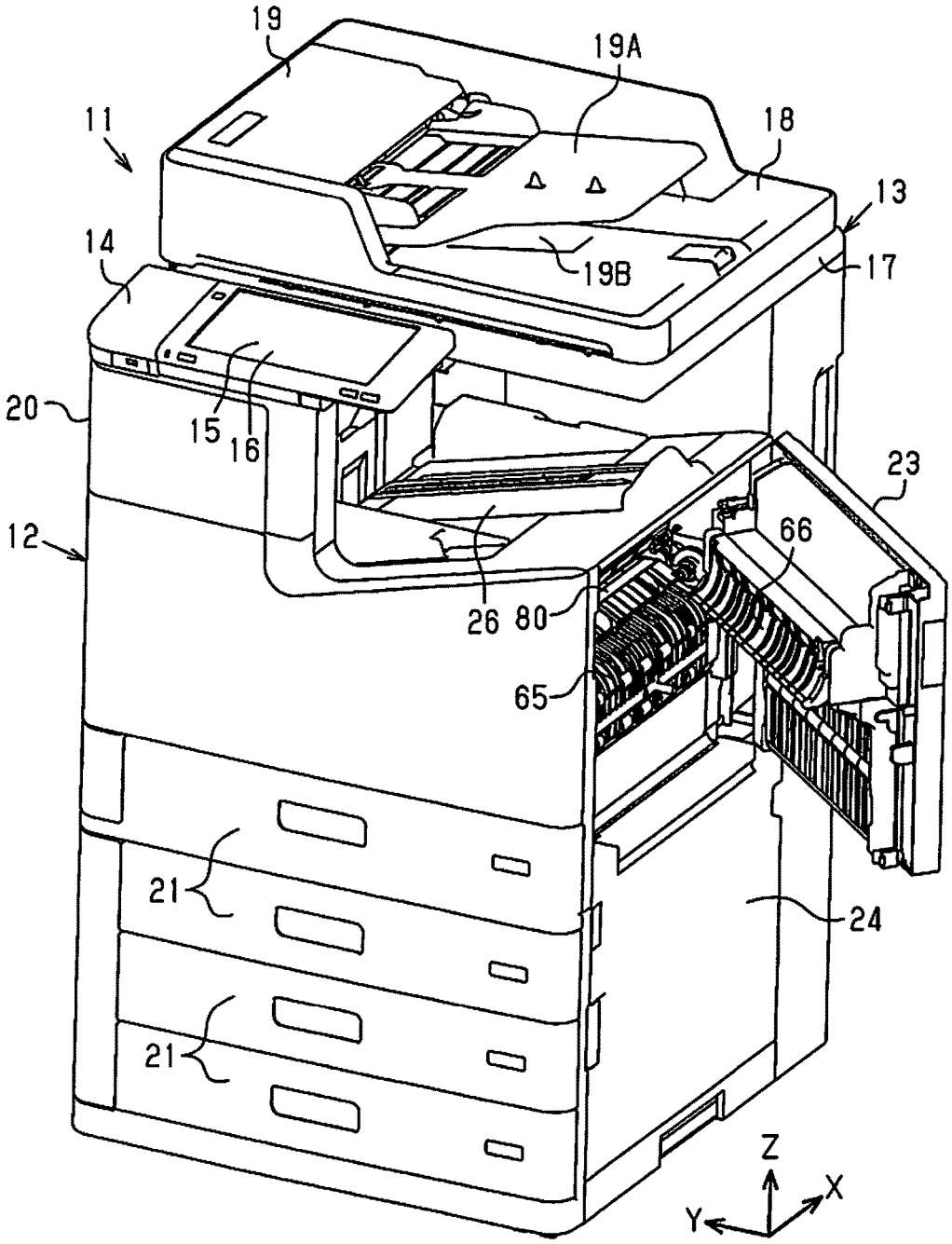
FIG. 3 is a perspective view of the printing apparatus with a cover opened.
Figure 4:
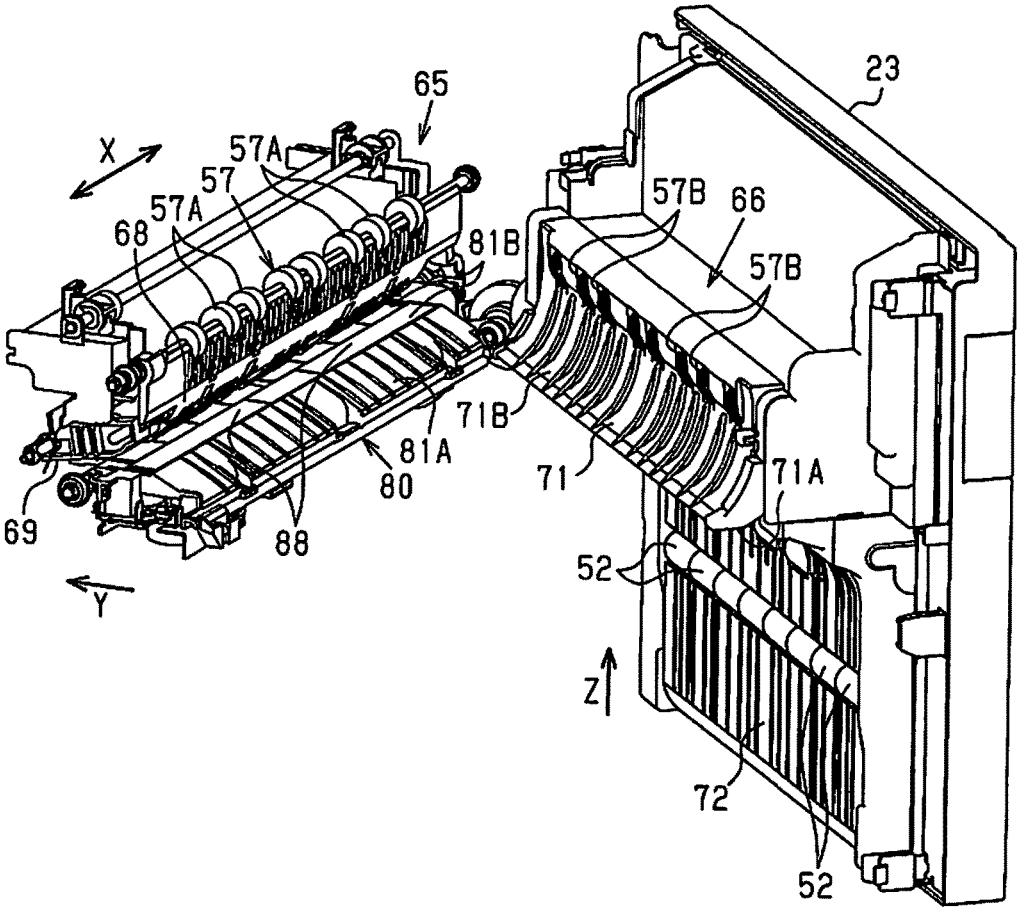
FIG. 4 is a perspective view illustrating a main body side feed mechanism unit and a cover side feed mechanism unit with the cover opened.

As illustrated in FIG. 3 and FIG. 4, when the cover 23 that is openable and closable with respect to the apparatus main body 20 of the printing apparatus 11 is opened, a part of each of the feed units 41 to 43 is exposed. Each of the feed units 41 to 43 is configured of a main body side feed mechanism unit 65 and a cover side feed mechanism unit 66. The main body side feed mechanism unit 65 is attached to a frame, not illustrated, in the main body 20. The cover side feed mechanism unit 66 is attached to the inner surface side of the cover 23. The medium detection device 80 is attached on the main body 20 side. The medium detection device 80, while supporting the medium P in feed or transport with the upper surface thereof, reads the medium P in the width direction X through a window portion 88 of the upper surface thereof and detects a side edge of the medium P. Thus, a medium guide unit 81A and a medium support unit 81B that constitute the upper surface part of the medium detection device 80 supporting the medium P also constitute a part of the main body side feed mechanism unit 65.

Figure 7:
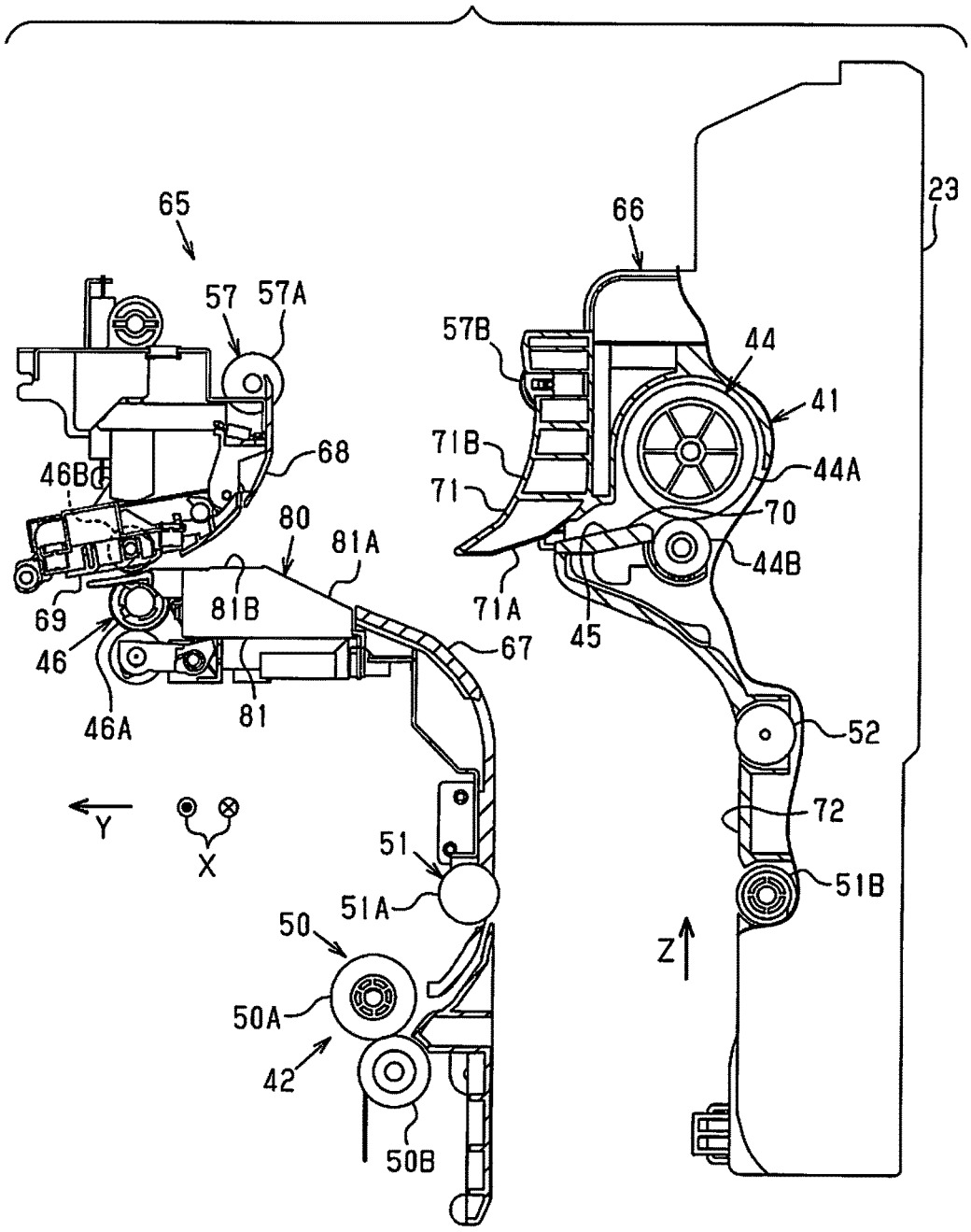
FIG. 7 is a side sectional view illustrating the main body side feed mechanism unit and the cover side feed mechanism unit with the cover opened.

As illustrated in FIG. 5 and FIG. 7, the main body side feed mechanism unit 65 includes the separating roller pair 50 constituting the second feed unit 42, a drive roller 51A, a guide member 67, a drive roller 57A constituting the third feed unit 43, guide members 68 and 69, the transport roller pair 46, and the like. In addition, the medium detection device 80 includes the medium guide unit 81A of a sloping shape in the upstream part thereof in the transport direction Y in the upper surface portion of a casing 81. The medium guide unit 81A guides the medium P from the second feed path 48. Furthermore, the medium detection device 80 includes the medium support unit 81B in the upper surface part that is downstream of the medium guide unit 81A in the transport direction Y in the casing 81. The medium support unit 81B supports the medium P from the first feed path 45 and the second feed path 48. Thus, the medium guide unit 81A and the medium support unit 81B constitute a part of the main body side feed mechanism unit 65.

As illustrated in FIG. 5 and FIG. 7, the cover side feed mechanism unit 66 includes the feed roller pair 44 constituting the first feed unit 41, guide members 70 and 71, passive rollers 51B and 52 constituting the second feed unit 42, a guide member 72, and a passive roller 57B constituting the third feed unit 43. The guide member 71 that is integrally attached to the cover 23 includes a medium guide surface 71A constituting the first feed path 45 and a medium guide surface 71B constituting the inversion feed path 56.

The cover side feed mechanism unit 66 includes a feed mechanism that feeds the medium P from at least one of the feed tray 22 and the cassette 21 constituting one example of a plurality of medium mount units. In the present example, one example of a plurality of medium mount units is both of the feed tray 22 and the cassette 21, and the entirety of the first feed unit 41 and a part of the second feed unit 42 are attached to the cover 23 as one example of at least a part of a feed unit.

As illustrated in FIG. 5 and FIG. 6, the feed roller pair 44 includes a drive roller 44A and a passive roller 44B. The guide member 70 and the medium guide surface 71A of the guide member 71 are arranged to face each other downstream of both of the rollers 44A and 44B in the feed direction and thereby form a part of the first feed path 45. In addition, the guide members 67 and 72 facing each other and the medium guide unit 81A of the medium detection device 80 form a part of the second feed path 48.

As illustrated in FIG. 5, the separating roller pair 50 constituting the second feed unit 42 is configured of a drive roller 50A and a passive roller 50B.

In addition, as illustrated in FIG. 5 and FIG. 6, the inversion transport roller pair 57 constituting the third feed unit 43 is configured of the drive roller 57A and the passive roller 57B. The downstream part of the inversion feed path 56 that inverts and feeds the medium P after printing is performed on the single side thereof is formed by the guide member 68 on the main body 20 side and the guide member 71 on the cover 23 side that are arranged to face each other. In addition, the surface of the medium detection device 80 facing the guide member 68 forms a part of the inversion feed path 56. In addition, the transport roller pair 46 arranged in a position downstream of the medium detection device 80 in the transport direction Y is configured of a drive roller 46A and a passive roller 46B.

Figure 16:
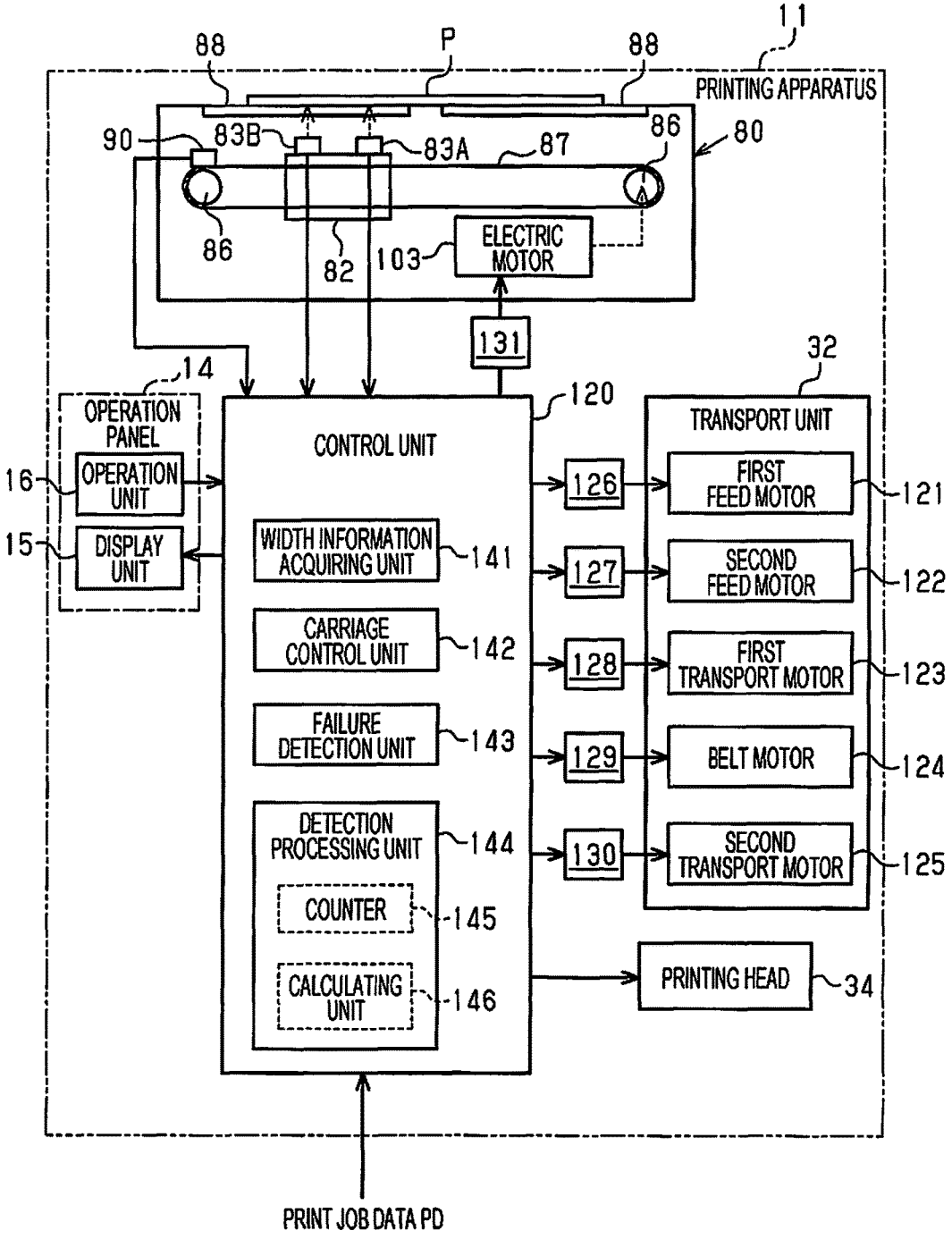
FIG. 16 is a block diagram illustrating an electrical configuration of the printing apparatus.

The drive roller 44A illustrated in FIG. 5 is driven by the motive power of a first feed motor 121 (refer to FIG. 16). In addition, the drive rollers 50A and 51A are driven by the motive power of a second feed motor 122 (refer to FIG. 16). In addition, the drive roller 46A and the drive roller 57A are driven by the motive power of a first transport motor 123 (refer to FIG. 16). The belt transport mechanism 58 illustrated in FIG. 2 is driven by the motive power of a belt motor 124 (refer to FIG. 16). In addition, the discharge mechanism unit 38 illustrated in FIG. 2 is driven by the motive power of a second transport motor 125 (refer to FIG. 16).

As illustrated in FIG. 6, the first feed path 45 and the second feed path 48 are joined in a first joint portion 75. Downstream of the first joint portion 75 in the feed direction (transport direction Y), the second feed path 48 as one example of a transport path and the inversion feed path 56 as one example of a double-sided printing path are joined in a second joint portion 76 as one example of a path joint portion. That is, a first common feed path 77 that is a common feed path for the medium P fed from the feed tray 22 and for the medium P fed from the cassette 21 is between the first joint portion 75 and the second joint portion 76. A second common feed path 78 that is a common feed path for the medium P fed before printing in order to perform printing on one side of the medium P and for the medium P fed again after printing in order to perform printing on the other side for double-sided printing after printing is performed on one side is downstream of the second joint portion 76 in the feed direction (transport direction Y). The second joint portion 76 that is a joint portion of the first feed path 45, the second feed path 48, and the first common feed path 77 constituting one example of a single-sided printing path and the inversion feed path 56 exist upstream of the printing head 34 (refer to FIG. 2) in the transport direction Y.

As illustrated in FIG. 6, a plurality of medium guide surfaces forming the second joint portion 76 is the surfaces of the downstream parts of the two medium guide surfaces 71A and 71B of the guide member 71, the downstream part of a medium guide surface 68A forming the inversion feed path 56, and the slightly downstream part of the medium support unit 81B of the medium detection device 80. These surfaces form a part (joint region) in which the medium P is joined. The guide member 71 attached to the cover 23 (refer to FIG. 5 and FIG. 7) includes a part of the medium guide surfaces 71A and 71B forming the second joint portion 76. Particularly, a location where the two medium guide surfaces 71A and 71B of the guide member 71 intersect with each other forms the second joint portion 76.

As illustrated in FIG. 5 and FIG. 6, the medium detection device 80 is arranged on the lower side of the first joint portion 75 and the second joint portion 76. The upper surface portion of the casing 81 of the medium detection device 80 constitutes a part of the second feed path 48, the first common feed path 77, and the second common feed path 78. In addition, a sensor 79 that can detect the edge portion of the medium P in the transport direction Y is disposed upstream of the transport roller pair 46 in the transport direction Y. The sensor 79 is used to determine the timing of a skew operation for the medium P performed by the transport roller pair 46, by sensing the leading edge of the medium P in the transport direction Y.

Figure 12:
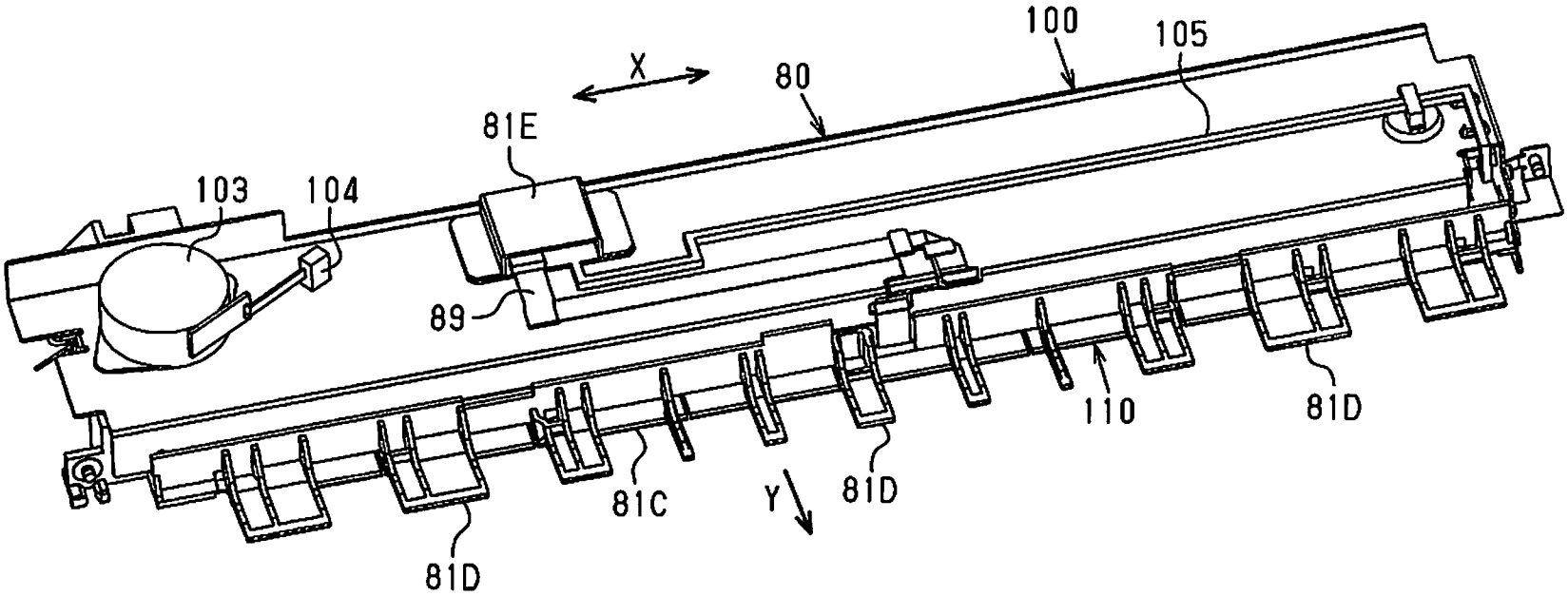
FIG. 12 is a perspective view of the medium detection device seen from a rear surface side thereof.

As illustrated in FIG. 6, the medium detection device 80 includes the above casing 81, a carriage 82, a sensor 83, and an electric motor 103 (refer to FIG. 12 and FIG. 16). The carriage 82 is accommodated in the casing 81 to be movable in the width direction X (the direction orthogonal with respect to the page of FIG. 6). The sensor 83 is disposed on the side of the carriage 82 facing the transport path 30. The electric motor 103 moves the carriage 82 as one example of a motive power source.

A pair of rail units 84 and 85 that guides the carriage 82 to be movable in the width direction X is disposed in the casing 81. The carriage 82 is fixed to a part of a belt 87 of an endless shape that is wound to a plurality of pulleys 86 (only one of which is illustrated in FIG. 6). The medium detection device 80 employs a belt drive type that renders the carriage 82 to reciprocate in the width direction X by rotation of the belt 87 by the motive power of the electric motor 103. Since the medium detection device 80 is disposed separately from the printing head 34, the carriage 82 and the sensor 83 can move in the width direction X independently of the printing head 34 (refer to FIG. 2).

As illustrated in FIG. 6, the window portion 88 that is configured of a light transmissive member is disposed in a part of the casing 81 of the medium detection device 80, the part facing the detection direction side of the sensor 83 when the carriage 82 moves. The light transmissive member constituting the window portion 88 is configured of a transparent member such as transparent glass or transparent plastic. The sensor 83 of the present example is an optical sensor and optically reads the medium P fed along the first common feed path 77 through the window portion 88 and thereby detects a side edge of the medium P in the width direction X. The carriage 82 can move in the width direction X in a position upstream of the printing head 34 in the transport direction Y. Thus, the sensor 83 can detect a side edge of the medium P in a position upstream of the printing head 34 in the transport direction Y. Accordingly, the side edge position of the medium P that is detected in advance by the medium detection device 80 can be used in control of the printing head 34 that performs printing in a position downstream of the side edge position.

As illustrated in FIG. 6, in a region that the sensor 83 faces through the window portion 88 in the detection direction thereof (light emission direction), that is, a facing region corresponding to a read position, a part of the medium guide surface 71A of the guide member 71 horizontally extends parallel to the window portion 88 in the transport direction Y and parallel to the moving path of the sensor 83 in the width direction X. That is, a part of the medium guide surface 71A is a horizontal surface from which the distance to the sensor 83 can be maintained equally in any position on the moving path of the sensor 83. At least a region of the horizontal part of the medium guide surface 71A facing the moving path of the sensor 83 is a light reflective surface 71C that reflects light from the sensor 83. The guide member 71 of the present example is made of metal, and the light reflective surface 71C is formed by processing the corresponding part of the medium guide surface 71A of the guide member 71 into a specular surface by, for example, polishing or plating.

The light reflective surface 71C is formed to have a sufficiently higher light reflectance than the medium P. The sensor 83 of a light reflective type receives reflective light from the light reflective surface 71C and outputs an L level in a case where a detected voltage value corresponding to the received light intensity exceeds a threshold, and receives reflective light from the medium P and outputs an H level in a case where the detected voltage value corresponding to the received light intensity is less than or equal to the threshold (refer to FIG. 18 and FIG. 19). That is, the sensor 83 outputs the L level when the medium P is not sensed, and outputs the H level in a case where the medium P is sensed. The sensor 83 is preferably capable of outputting a detected signal corresponding to the presence or absence of the medium P. The light reflective surface 71C may be a surface having a sufficiently lower reflectance than the medium P by, for example, performing coating or surface roughening on the light reflective surface 71C.

As illustrated in FIG. 6, a part of the second feed path 48 is formed by the medium guide unit 81A of a sloping shape in the upper surface portion of the casing 81 of the medium detection device 80. In addition, the window portion 88 and a medium guide unit 81C, in the upper surface portion of the casing 81, that is positioned downstream of the window portion 88 in the transport direction Y constitute the medium support unit 81B by which both the medium P fed from the feed tray 22 and the medium P fed from the cassette 21 are supported. The medium detection device 80 includes an extending portion 81D that extends from the upper portion of the casing 81 to the downstream side thereof in the transport direction Y. The extending portion 81D is arranged in a position that faces the guide member 69 configured of a part of a support member supporting the passive roller 46B, and forms a part of the second common feed path 78.

As illustrated in FIG. 6, the carriage 82 is disposed to be movable in the width direction X in a position that is on the opposite side from the printing head 34 side of the transport path 30 of the medium P transported by the transport unit 32. The sensor 83 irradiates the medium P with light from a position that is on the opposite side from the printing head 34 side with the transport path 30 interposed therebetween, and thereby can detect a side edge of the medium P.

As illustrated in FIG. 6, the medium detection device 80 is arranged in a position where the read position (a broken lined position in FIG. 6) of the sensor 83 is upstream in the transport direction Y of the second joint portion 76 in which the first common feed path 77 and the inversion feed path 56 are joined. When the medium detection device 80 is arranged in, for example, a position where the medium P after printing is performed on one side thereof can be read, the second joint portion 76 is required to be arranged to be shifted upstream of the read position of the medium detection device 80 in the transport direction, and consequently, the third feed unit 43 including the inversion feed path 56 and the first feed unit 41 are required to be arranged to be shifted upstream in the transport direction Y. In this case, the feed mechanism unit 35 of the printing apparatus 11 is required to be arranged in a position moved back upstream in the transport direction Y, and the size dimension of the printing apparatus 11 in the transport direction Y is increased by the amount of moving back, and the size of the printing apparatus 11 is increased in the transport direction Y.

Regarding this point, the first feed unit 41 and the third feed unit 43 are not required to be arranged to be shifted upstream in the transport direction Y by arranging a second path joint portion J2 in a position downstream of the read position with respect to the medium detection device 80 without reading a side edge of the medium P after printing is performed on one side thereof. Accordingly, the size dimension of the printing apparatus 11 in the transport direction Y is relatively short.

As illustrated in FIG. 6, a first feed path 91 that is a path of the medium P fed by rotation of the feed roller pair 44 and a second feed path 92 that is a path of the medium P fed along the second feed path 48 are joined in a first path joint portion J1 that is positioned slightly downstream of the first joint portion 75. Furthermore, a third feed path 93, as one example of a double-sided printing path, that is a path of the medium P fed along the inversion feed path 56 is joined to the second feed path 92 in the second path joint portion J2, as one example of a joint portion, that is positioned slightly downstream of the second joint portion 76. The read position of the medium detection device 80 is positioned upstream of the second path joint portion J2 in the transport direction Y. In addition, the read position of the medium detection device 80 is positioned downstream of the first path joint portion J1 in the transport direction Y. The position area of the read position is a part of a common transport path along which each medium P fed from the cassette 21 and the feed tray 22 is transported, the part being upstream of the second path joint portion J2.

Thus, regardless of the feed source (medium mount unit) from which the medium P comes, a side edge can be detected by reading the medium P with an approximately constant distance maintained between the medium P and the sensor 83, and what is easily avoided is that ink from printing performed on one side of the medium P fed through the inversion feed path 56 clings to the window portion 88. Accordingly, a decrease in the accuracy of detection of a side edge of the medium P or erroneous detection due to irregularity of the distance between the sensor 83 and the medium P in the read position, staining of the window portion 88 with ink, and the like are reduced.

In the present embodiment, the read position of the medium detection device 80 is preferably upstream of the second path joint portion J2 in the transport direction Y. In addition, the read position is preferably upstream of the second joint portion 76 in the transport direction Y. Furthermore, the read position of the medium detection device 80 is preferably downstream of the first joint portion 75 in the transport direction Y. In addition, the read position is preferably downstream of the first path joint portion J1 in the transport direction Y.

If the read position is positioned upstream of the second joint portion 76, the guide member 71 that includes the two medium guide surfaces 71A and 71B forming the second joint portion 76 is positioned to face the moving path of the sensor 83. In the present example, the light reflective surface 71C that reflects light from the sensor 83 is formed in a region of the guide member 71 facing the sensor 83, and the same member is intended to be used for guiding a medium and for the light reflective surface.

Figure 8:
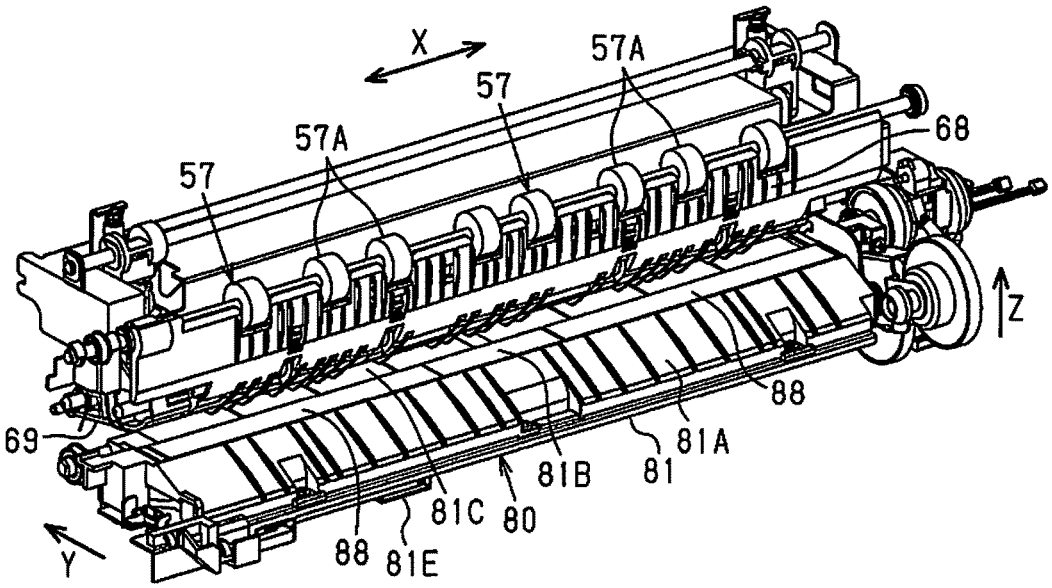
FIG. 8 is a perspective view illustrating a medium detection device and a surrounding part thereof.

As illustrated in FIG. 7, when the cover 23 is opened, the cover side feed mechanism unit 66 that includes the guide member 71, the guide member 72, and the like moves in the receding direction (upstream in the transport direction Y) along with the cover 23, and the medium detection device 80 is exposed. That is, since the read position of the medium detection device 80 is arranged to be positioned upstream of the second path joint portion J2 in the transport direction Y, the medium detection device 80 is exposed as illustrated in FIG. 7 and FIG. 8 when the guide member 71 forming the second joint portion 76 recedes rearward. Particularly, since the read position is arranged to be positioned upstream of the second joint portion 76 in the transport direction Y, the window portion 88 is also exposed as illustrated in FIG. 7 and FIG. 8 when the guide member 71 forming the second joint portion 76 recedes rearward. For example, cleaning that removes stains on the surface of the window portion 88 can be performed with the medium detection device 80 attached to the main body 20.

Next, a detailed configuration of the medium detection device 80 will be described with reference to FIG. 8 to FIG. 15.

As illustrated in FIG. 8, the medium detection device 80 has a long shape that extends slightly longer in the width direction X than the maximum width of the medium P. Two window portions 88 are disposed in the width direction X (casing longitudinal direction). Center feeding in which the width center of the medium P passes through the position of the width center of a feed path independently of the size of the medium P is performed in the printing apparatus 11 of the present embodiment. The two window portions 88 and the medium guide unit 81C form the medium support unit 81B. In addition, the medium detection device 80 includes a connector 81E in the lower portion of the casing 81. A connector, not illustrated, that is connected to an interconnect from a control unit 120 is connected to the connector 81E, and the detected signal of the sensor 83 is input into the control unit 120 through the connector 81E and an interconnect not illustrated.

Figure 9:
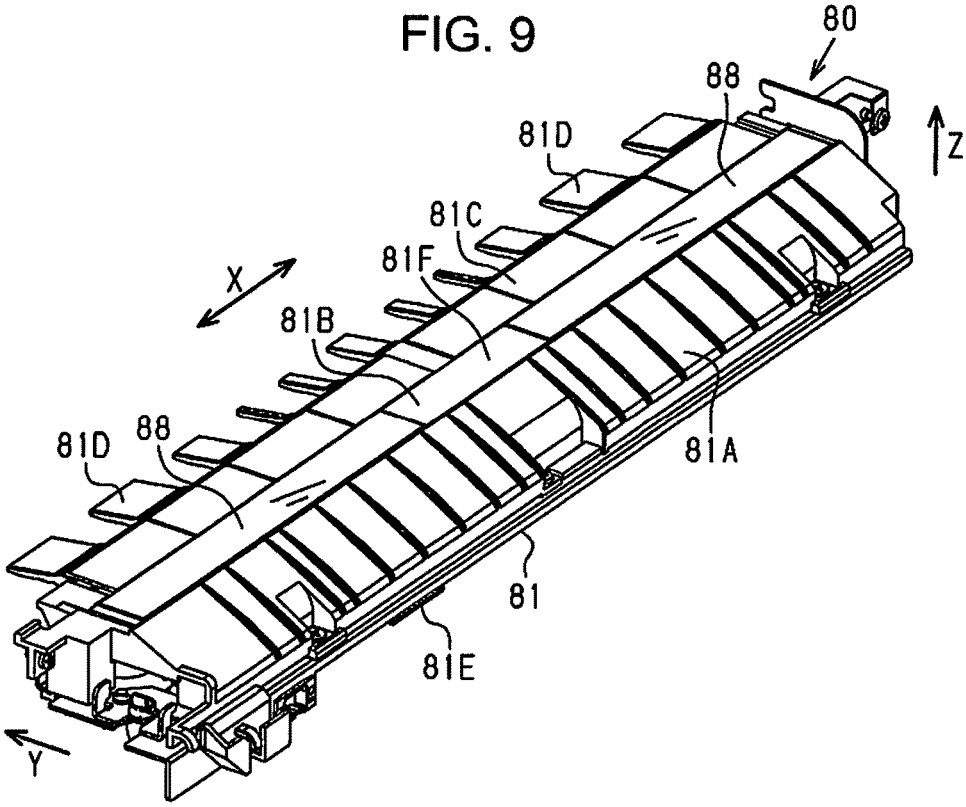
FIG. 9 is a perspective view illustrating the medium detection device.

As illustrated in FIG. 9, the upper surface of the medium detection device 80 includes the medium guide unit 81A, the two window portions 88, a support unit 81F interposed between the two window portions 88, the medium guide unit 81C, and the extending portion 81D. The medium P fed from the cassette 21 is guided by the medium guide unit 81A. In addition, the medium P fed from the cassette 21 and the medium P fed from the feed tray 22 are guided to a support surface that is configured of the window portion 88 and the upper surfaces of the support unit 81F and the medium guide unit 81C. The extending portion 81D is extended in plural numbers in the shape of teeth of a comb, each of which is inserted in a gap between a plurality of the transport roller pairs 46 disposed in the width direction X. The medium P when being inserted into the transport roller pair 46 is supported by the upper surface of the plurality of extending portions 81D.

Figure 10:
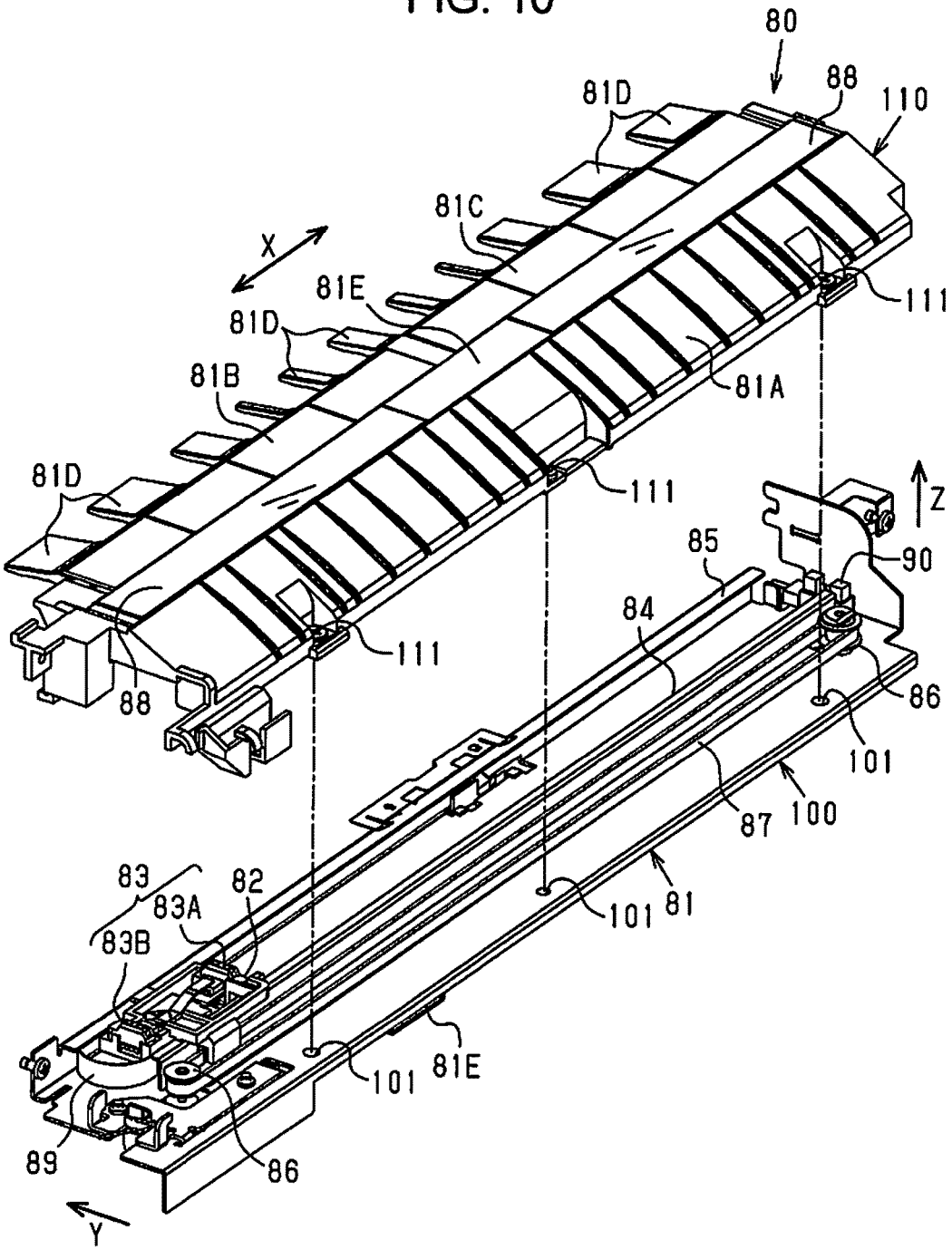
FIG. 10 is an exploded perspective view illustrating the medium detection device.

As illustrated in FIG. 10, the casing 81 of the medium detection device 80 is configured of a base 100 and a cover 110. The pair of rail units 84 and 85 is disposed to extend parallel to each other in the longitudinal direction on the upper surface of the base 100.

The carriage 82 is attached to be movable in the longitudinal direction of the casing 81 along the pair of rail units 84 and 85. In addition, a pair of the pulleys 86 is attached to the upper surface of the base 100 at a predetermined interval in the longitudinal direction in each position corresponding to both end portions of the base 100 in the longitudinal direction. The belt 87 of an endless shape is wound to the pair of pulleys 86, and the carriage 82 is fixed to a part of the belt 87.

The sensor 83 disposed in the carriage 82 is configured of a pair of sensors 83A and 83B that is arranged in a different position in the longitudinal direction of the casing 81 (width direction X). In addition, the central portions of the upper surfaces of the carriage 82 and the base 100 in the longitudinal direction are connected through a flexible flat cable 89. In addition, a position sensor 90 that senses the carriage 82 being in a home position which is the end portion of the moving path thereof in the width direction X is disposed in the end portion of the upper surface of the base 100 in the longitudinal direction. In the following description, the sensor 83A may be referred to as a first sensor 83A, and the sensor 83B may be referred to as a second sensor 83B.

As illustrated in FIG. 10, a plurality of screw holes 101 is formed in the base 100 at appropriate intervals in the peripheral portion of the base 100 in the peripheral direction. In the peripheral portion of the cover 110, a screw 111 that is inserted in a plurality of screw insertion holes, not illustrated, formed in a position corresponding to the screw hole 101 screws into the corresponding screw hole 101 on the base 100 side, and thereby the base 100 and the cover 110 are integrally attached to each other, and the casing 81 is formed.

Figure 11:
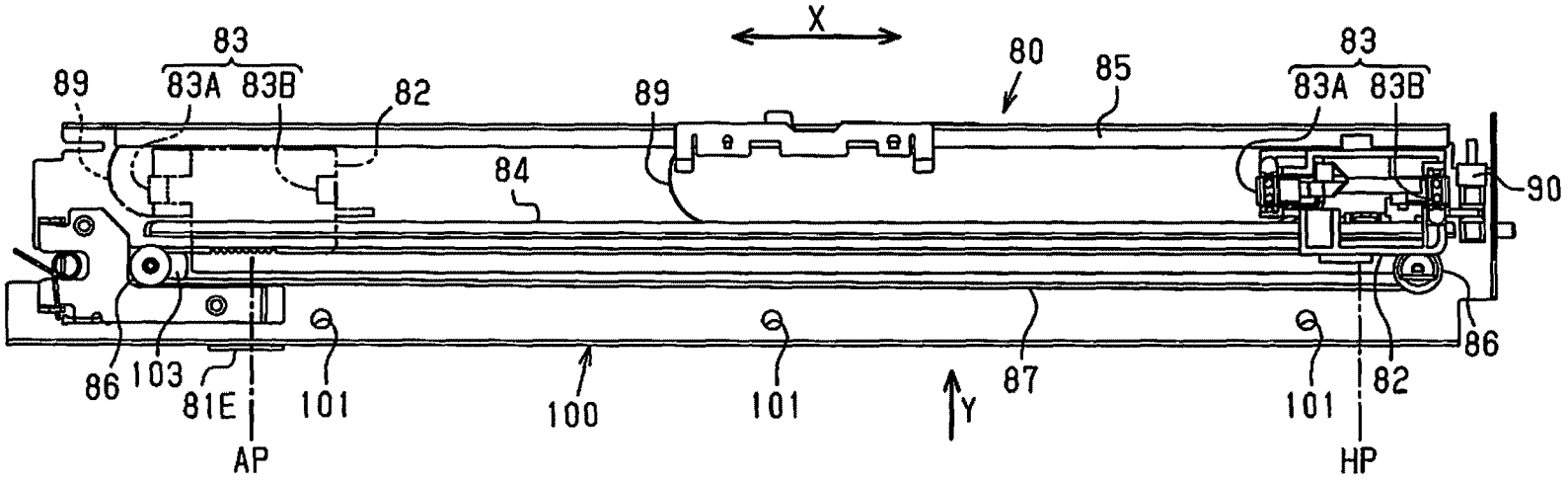
FIG. 11 is a plan view illustrating the medium detection device with a cover thereof detached.

As illustrated in FIG. 11, the carriage 82 can move between a home position HP illustrated by a solid line in FIG. 11 and an anti-home position AP that is the opposite side end portion from the home position HP in the width direction X and is illustrated by a double-dot chain line in FIG. 11. One end portion of the flexible flat cable 89 is fixed to the central portion of the peripheral portion of the base 100 in the longitudinal direction. The part of the flexible flat cable 89 extending from the fixed location is wired along one rail unit 85 and is curved in an arc shape midway of the rail unit 85 and is then wired along the other rail unit 84, and the other end portion of the flexible flat cable 89 is connected to the carriage 82. The arc-shaped part of the flexible flat cable 89 moves in the width direction X along with movement of the carriage 82, and thereby the flexible flat cable 89 maintains electrical connection with the carriage 82 in movement.

As illustrated in FIG. 11, the home position HP and the anti-home position AP of the carriage 82 are end positions on both sides when the carriage 82 moves in the width direction X. The position sensor 90 is ON when the carriage 82 is in the home position HP and is OFF when the carriage 82 is in a position separated from the home position HP.

As illustrated in FIG. 12, the electric motor 103 is attached to the rear surface of the base 100. The drive axis of the electric motor 103 is connected to one pulley 86 (the pulley 86 on the left side in FIG. 11). The electric motor 103 of the present example is configured of a stepping motor. A connector 104 is connected to the tip end of an interconnect extending from the electric motor 103. A connector, not illustrated, that is connected to an interconnect extending from the control unit 120 is connected to the connector 104, and electricity and a control signal are input from the control unit 120 into the electric motor 103 through the interconnect. The electric motor 103 is driven to rotate forward and reversely based on the control signal (step control signal) from the control unit 120, and thereby the carriage 82 reciprocates in the width direction X by forward and reverse rotation of the belt 87.

As illustrated in FIG. 12, an interconnect of the flexible flat cable 89 extends from the surface side (inner surface side) of the base 100 and is exposed to the rear surface side thereof on the rear surface of the base 100. The interconnect is wired on the rear surface while being held along a predetermined path and is connected to the connector 81E. In addition, in the connector 81E, an interconnect 105 that extends from the position sensor 90 extends from the outer surface side (inner surface side) of the base 100 and is exposed to the rear surface side thereof, and the interconnect 105 is wired on the rear surface of the base 100 while being held along a predetermined path and is connected to the connector 81E.

Figure 13:
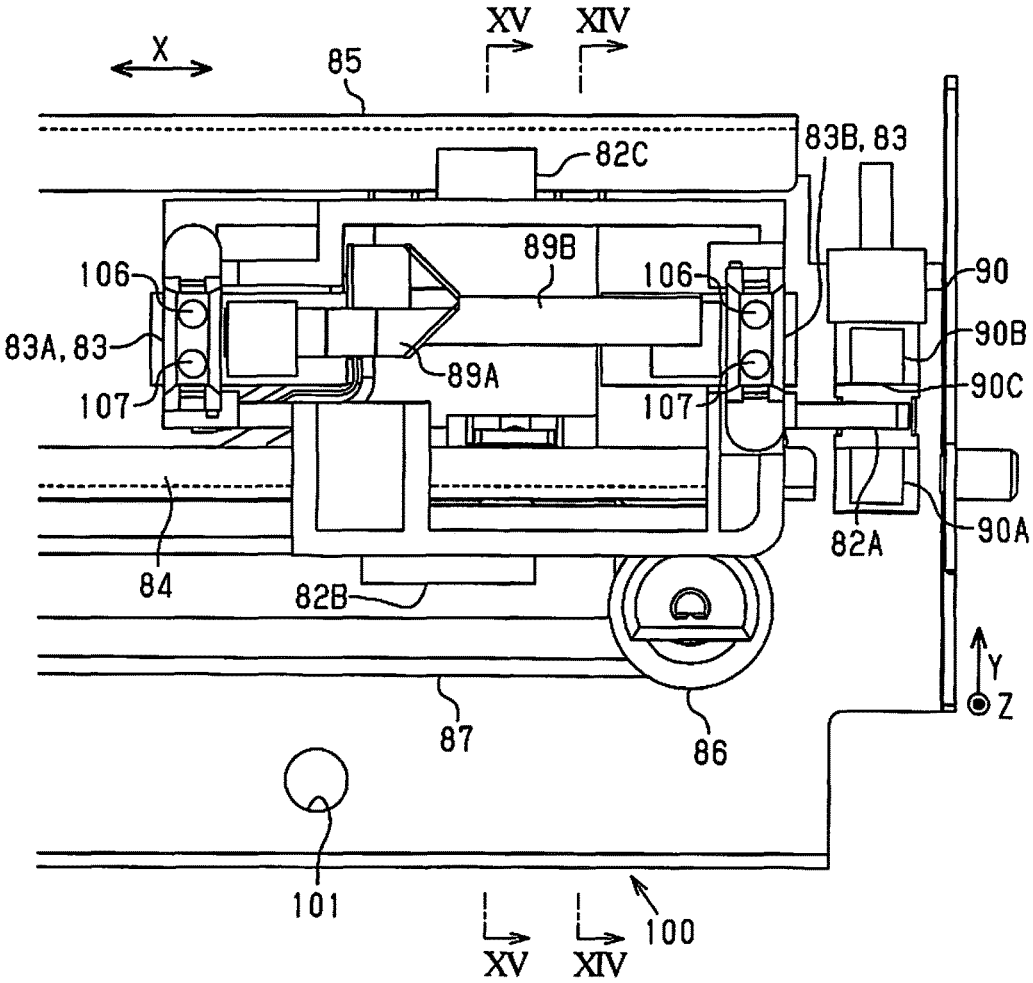
FIG. 13 is a plan view illustrating a carriage in a home position.

As illustrated in FIG. 13, the two sensors 83A and 83B include a light emitting unit 106 and a light receiving unit 107. Light emitted from the light emitting unit 106 is reflected, and the light receiving unit 107 receives the reflective light, and thereby the sensors 83A and 83B outputs a detected signal at a voltage level corresponding to the received light intensity. An interconnect 89A that extends from the first sensor 83A is partially folded and convoluted midway and is connected with an interconnect 89B extending from the second sensor 83B, thereby constituting one flexible flat cable 89. The flexible flat cable 89 is inserted into an interconnect hole formed in the carriage 82 and extends to the rear surface side of the carriage 82 and then is wired along the inside surface of the rail unit 84.

As illustrated in FIG. 13, the position sensor 90 includes a light emitting unit 90A and a light receiving unit 90B. The carriage 82 includes a detected portion 82A that protrudes outward in the width direction X from the side portion thereof on the home position HP side. When the carriage 82 is in the home position HP, the detected portion 82A that is inserted in a recess 90C between the light emitting unit 90A and the light receiving unit 90B blocks light projected from the light emitting unit 90A to the light receiving unit 90B, and thereby the position sensor 90 is placed into a sensing state. Meanwhile, in a state where the carriage 82 moves from the home position HP to the anti-home position AP side, the detected portion 82A recedes from the recess 90C, and the light receiving unit 90B receives light that is projected from the light emitting unit 90A to the light receiving unit 90B, and thereby the position sensor 90 is placed into a non-sensing state.

Figure 14:
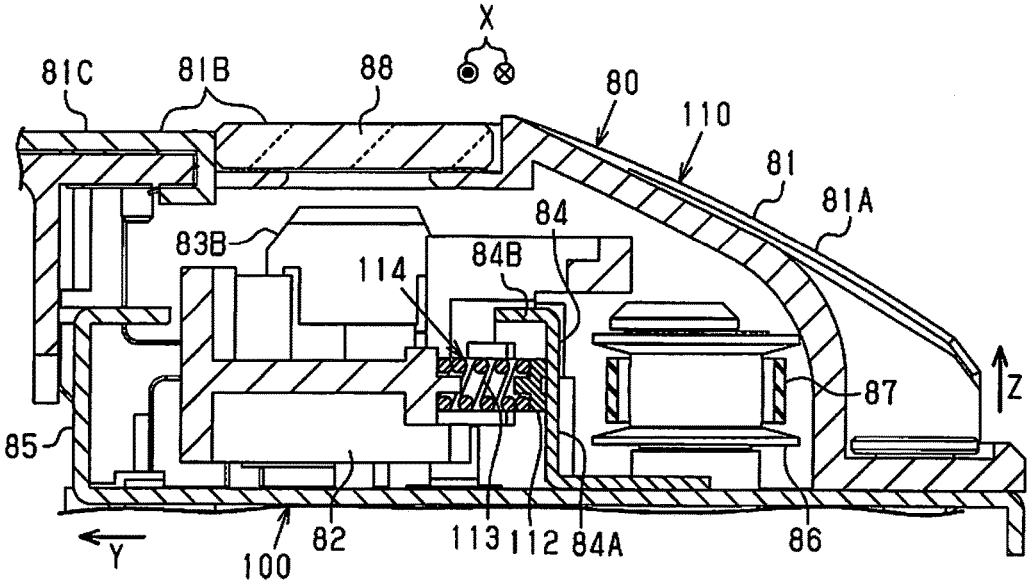
FIG. 14 is a sectional view taken along a line XIV-XIV in FIG. 13 and illustrating a main portion of the medium detection device.

As illustrated in FIG. 14, the rail unit 84 includes a vertically standing portion 84A and a support unit 84B. The vertically standing portion 84A extends vertically with respect to the base 100 in the vertical direction Z. The support unit 84B is curved from the upper end portion of the vertically standing portion 84A and extends horizontally. A positioning mechanism 114 that is configured by pressing a pressing member 112 with pressing force of a compression spring 113 against the vertically standing portion 84A of the rail unit 84 is disposed in the carriage 82. The pressing member 112 is pressed to the vertically standing portion 84A of the rail unit 84 with predetermined pressing force in the horizontal direction, and thereby the carriage 82 is positioned in the transport direction Y. Thus, rattling of the carriage 82 in the transport direction Y is prevented.

Figure 15:
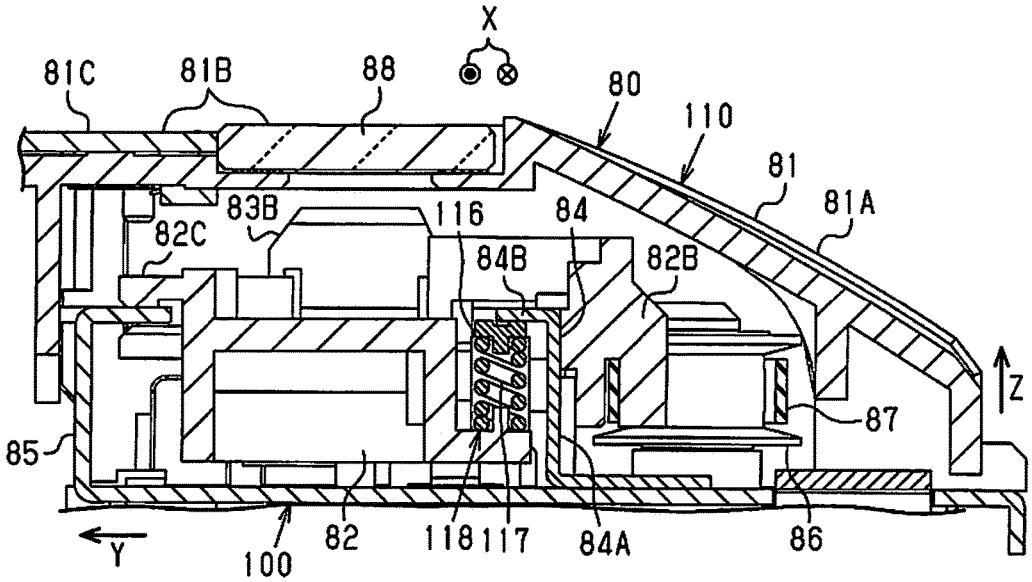
FIG. 15 is a sectional view taken along a line XV-XV in FIG. 13 and illustrating a main portion of the medium detection device.

As illustrated in FIG. 15, the carriage 82 includes a positioning mechanism 118 that is configured by pressing a pressing member 116 with pressing force of a compression spring 117 against the support unit 84B of the rail unit 84. The pressing member 116 is pressed to the support unit 84B of the rail unit 84 with predetermined pressing force, and thereby the carriage 82 is positioned in the vertical direction Z. Thus, rattling of the carriage 82 in the vertical direction is prevented. In addition, the carriage 82 is fixed to the belt 87 with the belt 87 grasped by a grasping unit 82B that is disposed to protrude to the upstream side portion of the carriage 82 in the transport direction Y. In addition, a guide unit 82C of a plate shape that extends downstream in the transport direction Y from the carriage 82 is guided to the upper surface of the rail unit 85. The carriage 82, with the attitude thereof held in the transport direction Y and the vertical direction Z through the two types of positioning mechanisms 114 and 118, can move in the width direction X along the rail units 84 and 85 by driving of the belt 87.

The transport roller pair 46 illustrated in FIG. 2 and FIG. 6 is resist rollers and determines the timing of starting transport of the medium P downstream thereof. The leading edge portion of the medium P fed abuts the stopped transport roller pair 46, and thereby an unskewing operation of removing or reducing skewing (slanting movement) of the medium P is performed. When the medium P is abutting the transport roller pair 46, the medium P stops and rotates in plane at an angle corresponding to the slanting movement, and thereby skewing thereof is removed. After the unskewing operation, a feed speed at which the trailing edge portion side of the medium P is withdrawn by the feed units 41 and 42 and a transport speed at which the leading edge portion side of the medium P is withdrawn by rotation of the transport roller pair 46 are set to be equal, and thereby the medium P is brought onto the transport belt 61 of the belt transport mechanism 58 at a constant transport speed.

As illustrated in FIG. 6, the read position of the sensor 83 is set to a position upstream of a nip location in the transport direction Y. The nip location is where the transport roller pair 46 nips (pinches) the medium P. The medium detection device 80 detects a side edge of the medium P in the width direction X after unskewing. The medium detection device 80 can detect a side edge of the medium P that is stopped after unskewing or the medium P that starts to be transported at a low speed after unskewing. Thus, in the case of using a configuration in which, for example, the medium detection device detects a side edge of the medium P in a position downstream of the transport roller pair 46 in the transport direction Y, a side edge of the medium P after unskewing can be detected, but the target of detection is the medium P that reaches a certain transport speed and is comparatively fast. Thus, in the case of, for example, detecting both side edges of the medium P, one side edge and the other side edge are detected in significantly different positions in the transport direction Y of the medium P. In this case, when skewing of the medium P remains slightly, the accuracy of detecting the width and a side edge of the medium P is slightly decreased. Regarding this point, according to the present embodiment in which the read position of the sensor 83 is set to be upstream in the transport direction Y of the nip location of the transport roller pair 46 used in the unskewing operation, the side edge position and the width of the medium P can be more accurately acquired than in the case of setting the read position of the sensor 83 to be downstream of the nip location of the transport roller pair 46 in the transport direction Y. A side edge detection process for the medium P may also be performed during transport of the medium P at a timing other than after unskewing, and side edge detection may be performed at a plurality of different locations in the transport direction Y of one sheet of the medium P.

Next, an electrical configuration of the printing apparatus 11 will be described with reference to FIG. 16. As illustrated in FIG. 16, the printing apparatus 11 includes the control unit 120 generally controlling the printing apparatus 11, the medium detection device 80, the above operation panel 14, the transport unit 32 transporting the medium P, and the printing head 34 performing printing on the medium P in transport. The transport unit 32 includes the first feed motor 121 and the second feed motor 122. The first feed motor 121 is the source of motive power of the first feed unit 41 that feeds the medium P set in the feed tray 22. The second feed motor 122 is the source of motive power of the second feed unit 42 that feeds the medium P accommodated in the cassette 21. In addition, the transport unit 32 includes the first transport motor 123, the belt motor 124, and the second transport motor 125. The first transport motor 123 is the source of motive power of the transport roller pair 46, the discharge mechanism unit 38, and the like transporting the fed medium P. The belt motor 124 is the source of motive power of the belt transport mechanism 58. The second transport motor 125 is the source of motive power of the transport roller pair 55 and the inversion transport roller pair 57 that transport the medium P after printing is performed on one side thereof.

The plurality of motors 121 to 125 is electrically connected to the control unit 120 through motor drive circuits 126 to 130 of the same number as the number of motors in a transport system. The control unit 120 controls each of the motors 121 to 125 through the motor drive circuits 126 to 130 and thereby performs inversion and discharge at the time of feeding and transporting of the medium P and double-sided printing. The second transport motor 125 may be removed by disposing an electromagnetic clutch that can switch the transport roller pair 55 to rotate forward or reversely, and by setting the source of motive power of the transport roller pair 55 and the inversion transport roller pair 57 to the first transport motor 123 which is the same source of motive power as the transport roller pair 46.

The printing head 34 is electrically connected to the control unit 120. The control unit 120 controls the printing head 34 based on graphic print data in the print job data PD received from, for example, a host apparatus (not illustrated) and thereby discharges ink drops from a nozzle of the printing head 34 to the part of the medium P in transport on the transport belt 61 and prints an image or the like based on the graphic print data on the medium P. In addition, the operation unit 16 and the display unit 15 constituting the operation panel 14 are electrically connected to the control unit 120. The control unit 120, based on an operation signal input from the operation unit 16, receives various types of setting information corresponding to items selected from a menu displayed on the display unit 15 or instruction information indicating performing of printing, scanning, copying, and the like. In addition, the control unit 120 displays the above menu, a message notifying a user when failure or malfunctioning occurs, and the like on the display unit 15.

The control unit 120 performs the unskewing operation for the medium P as follows. The control unit 120 performs the unskewing operation of removing or reducing skewing (slanting movement) of the medium P by, with driving of the first transport motor 123 stopped, driving the feed motor 121 or 122 to render the leading edge portion of the fed medium P to abut the stopped transport roller pair 46.

The control unit 120 temporarily stops driving of the feed motor 121 or 122 when the feed motor 121 or 122 finishes rotating the set amount of rotation required for the unskewing operation.

After the unskewing operation, the feed motor 121 or 122 and the first transport motor 123 are driven with the rotation speeds thereof synchronized, and thereby the medium P is transported onto the transport belt 61 at a constant transport speed. The control unit 120 starts driving the belt motor 124 before the medium P is transported to the transport belt 61, and the medium P is brought at a constant transport speed onto the transport belt 61 that is driven at a constant transport speed.

The electric motor 103 that is the source of motive power of the carriage 82 of the medium detection device 80, the position sensor 90, and the first sensor 83A and the second sensor 83B on the carriage 82 are electrically connected to the control unit 120 illustrated in FIG. 16. The control unit 120 drives and controls the electric motor 103 through the motor drive circuit 131 and thereby performs movement control that renders the carriage 82 to reciprocate in the width direction X of the medium P and performs position control that renders the carriage 82 to stop in a target stop position.

In addition, the control unit 120 illustrated in FIG. 16 recognizes whether or not the carriage 82 is in the home position HP based on a detected signal SH (refer to FIG. 18 and FIG. 19) that is input from the position sensor 90. The control unit 120 recognizes the carriage 82 as being in the home position HP if the detected signal SH input from the position sensor 90 is at a signal level (for example, the H level) indicating that the carriage 82 is in the home position HP, and recognizes the carriage 82 as not being in the home position HP if the detected signal SH is at a signal level (for example, the L level) indicating that the carriage 82 is not in the home position HP.

Furthermore, a detected signal SA from the first sensor 83A and a detected signal SB from the second sensor 83B (for each, refer to FIG. 18 and FIG. 19) are input into the control unit 120 illustrated in FIG. 16 during movement of the carriage 82. The control unit 120 detects both side edges of the detection target medium P in the width direction X based on each of the detected signals SA and SB input from the first sensor 83A and the second sensor 83B. The control unit 120, for example, from the result of detection of the side edges of the medium P in the width direction X, acquires medium information that is related to width such as side edge positions PE1 and PE2 (refer to FIG. 17), a printing area in the width direction X when the printing head 34 performs printing, the width of the medium P (for example, a paper width), and a medium size (for example, a paper size) defined from the width of the medium P.

The control unit 120 illustrated in FIG. 16 includes, for example, a computer and a memory, not illustrated, and includes a plurality of functional units that functions by the computer executing a program stored on the memory and is required for a medium detection process. The control unit 120, as the plurality of functional units, includes a width information acquiring unit 141, a carriage control unit 142, a failure detection unit 143, and a detection processing unit 144. The width information acquiring unit 141 acquires width information of the medium P. The carriage control unit 142 drives and controls the electric motor 103. The failure detection unit 143 can detect failure of the sensors 83A and 83B. The detection processing unit 144 can detect the side edge positions PE1 and PE2 of the medium P based on the detected signals SA and SB of the sensors 83A and 83B. The width information acquiring unit 141 acquires the width information of the medium P from printing setting information that is included in the print job data PD received by the control unit 120. The width information is, for example, information as to the medium size. The memory stores, for example, reference data that indicates a correspondence between the medium paper size and the width information, and the width information acquiring unit 141 acquires the width information by referencing the reference data based on the medium size acquired.

The carriage control unit 142 illustrated in FIG. 16 controls the electric motor 103 through the motor drive circuit 131 and thereby performs control that renders the carriage 82 to move in the width direction X and performs position control that renders the carriage 82 to stop in a target position. The failure detection unit 143, when the medium P is not transported, determines whether or not each of the detected signals SA and SB from the first sensor 83A and the second sensor 83B has a value at the time of failure and, if there is a sensor having a value at the time of failure, detects the sensor as failing. In the present example, the H level is a detected value when the medium P is present, and if there is a sensor, of the sensors 83A and 83B, having the H level even though the medium P is not present, the sensor is detected as failing. In addition, if the sensors 83A and 83B receive reflective light from the light reflective surface 71C and have the L level that is a detected value when the medium P is not present, the sensors 83A and 83B are regarded as being normal.

The detection processing unit 144 detects a side edge of the medium P in the width direction X based on the detected signals SA and SB of the first sensor 83A and the second sensor 83B. The detection processing unit 144 includes a counter 145 and a calculating unit 146. The counter 145 counts the positions of the carriage 82 in the width direction X with the home position HP as the origin. The calculating unit 146 calculates the other side edge position of the medium P based on one side edge position and the width information of the medium P detected by the other of the first and second sensors 83A and 83B when one fails.

Figure 17:
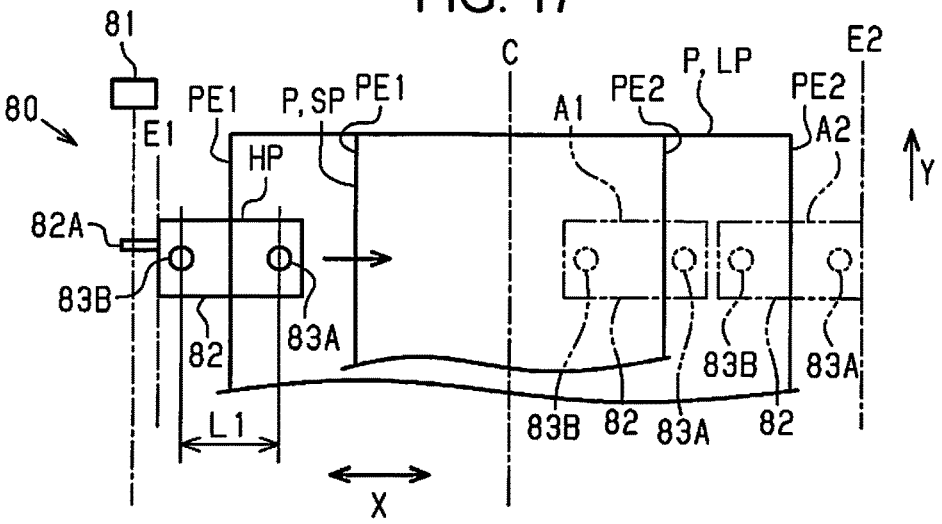
FIG. 17 is a schematic plan view illustrating a medium side edge detection process in the medium detection device.

FIG. 17 is a schematic diagram illustrating a method for detecting a side edge of a medium with two sensors and is a diagram seen from the rear surface side of the medium. As illustrated in FIG. 17, the first sensor 83A and the second sensor 83B are mounted on the upper portion of the carriage 82 at an inter-center distance L1 therebetween in the width direction X. When the carriage 82 is positioned in the home position HP (a solid line position in FIG. 17), in the case of a medium SP of a small size having a small width dimension, both of the sensors 83A and 83B are positioned outside of the medium SP in the width direction and do not sense the medium SP. Meanwhile, in the case of a medium LP of a large size having a large width dimension, when the carriage 82 is positioned in the home position HP, one sensor (the second sensor 83B in the example of FIG. 17) on the home position HP side is positioned outside of the medium LP in the width direction X and does not sense the medium LP. Regarding this point, the other sensor (the first sensor 83A in the example of FIG. 17) on the anti-home position AP side is in a position facing the medium LP and senses the medium LP.

In the present example, in a case where the medium P having the maximum width is a detection target, when the carriage 82 is in a left side end position E1 (for example, the home position HP) in a movable range thereof, the right side sensor 83A of the two sensors 83A and 83B senses the medium P having the maximum width, and the left side sensor 83B does not sense the medium P having the maximum width. Meanwhile, when the carriage 82 is in a right side end position E2 in the movable range thereof, the left side sensor 83B of the two sensors 83A and 83B senses the medium P having the maximum width, and the right side sensor 83A does not sense the medium P having the maximum width. The movable range of the carriage 82 is relatively narrower than the width of the medium P having the maximum width. Thus, the size dimension of the medium detection device 80 in the width direction X is reduced to be relatively smaller than the width of the medium P having the maximum width, and even if the medium detection device 80 is disposed in the apparatus main body 20 in a direction in which the longitudinal direction of the medium detection device 80 matches the width direction X, the size dimension of the printing apparatus 11 in the width direction X is reduced to be relatively small.

The control unit 120 illustrated in FIG. 16 switches the number of sensors, of the two sensors 83A and 83B, used in the side edge detection process of detecting both side edge positions PE1 and PE2 of the medium P according to the size (width dimension) of the medium P. That is, in the case of the medium SP of a small size of which the medium width based on the width information is less than or equal to a set width, the control unit 120 uses only one sensor (for example, the first sensor 83A) to detect the side edge positions PE1 and PE2 of the medium SP. In addition, in the case of the medium LP of a large size of which the medium width exceeds the set width, the control unit 120 uses both of the first and second sensors 83A and 83B to detect the side edge positions PE1 and PE2 of the medium LP. With the carriage 82 being in the home position HP illustrated by a solid line, the set width is set to a value greater than or equal to the maximum medium width of medium widths in which both of the two sensors 83A and 83B cannot sense the medium P (for example, the medium SP) and less than the minimum medium width of medium widths in which the first sensor 83A can sense the medium P (for example, the medium LP), as illustrated in FIG. 17. In the case of regarding the width direction X in which the carriage 82 can move as the left-right direction in FIG. 17, the first sensor 83A corresponds to one example of a right side sensor, and the second sensor 83B corresponds to one example of a left side sensor. In addition, the first side edge PE1 of the medium P corresponds to one example of a left side edge, and the second side edge PE2 corresponds to one example of a right side edge.

Figure 18:
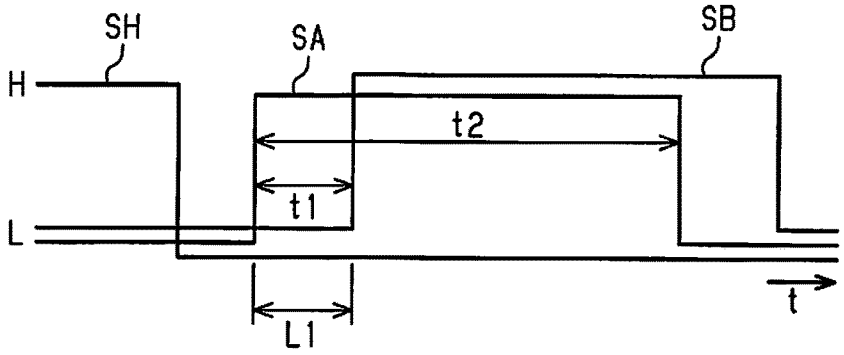
FIG. 18 is a signal waveform diagram of each sensor illustrating a side edge detection process for a medium of a small size.
Figure 19:
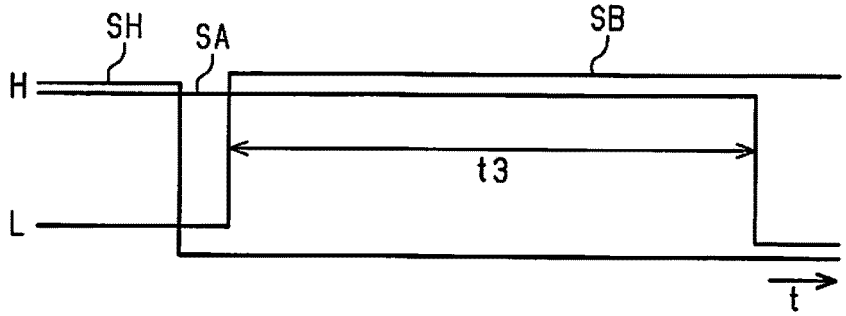
FIG. 19 is a signal waveform diagram of each sensor illustrating a side edge detection process for a medium of a large size.

FIG. 18 and FIG. 19 illustrate detected signals output from each of the sensors 83A, 83B, and 90 when both side edges of the medium P in the width direction X are detected. FIG. 18 is a signal waveform of each detected signal when a side edge of the medium SP of a small size of which the medium width is less than or equal to the set width is detected, and FIG. 19 is a signal waveform of each detected signal when a side edge of the medium LP of a large size of which the medium width exceeds the set width is detected. In FIG. 18 and FIG. 19, the horizontal direction indicates a time t, and the vertical direction indicates the voltage level of each of the detected signals SA, SB, and SH. The carriage 82 moves at a constant speed V1. Thus, the time t in the horizontal direction in FIG. 18 and FIG. 19 corresponds to the number of steps of the electric motor 103, that is, the distance of movement of the carriage 82.

As illustrated in FIG. 18, when the carriage 82 is positioned in the home position HP (the solid line position in FIG. 17) and the detected signal SH is at the H level in a case where the medium SP of a small size is a detection target, both of the sensors 83A and 83B do not sense the medium SP, and both of the detected signal SA and SB are at the L level. When the carriage 82 starts to move from the home position HP, first, the right side first sensor 83A senses the left side first side edge PE1, and the detected signal SA rises from the L level to the H level.

Furthermore, when the carriage 82 moves in a time t1 (=L1/V1) corresponding to the inter-center distance L1 between the two sensors 83A and 83B, the left side second sensor 83B senses the right side second side edge PE2, and the detected signal SB rises from the L level to the H level. Next, when the first sensor 83A moves in a time t2 corresponding to the medium width from the time point when the first side edge PE1 is detected, the first sensor 83A senses the second side edge PE2, and the detected signal SA falls from the H level to the L level. The number of steps of the electric motor 103 output during the period of the time t2 corresponds to the distance of movement of the carriage 82 during the period, and the distance of movement of the carriage 82 corresponds to the width of the medium SP.

In addition, as illustrated in FIG. 19, when the carriage 82 is positioned in the home position HP (the solid line position in FIG. 17) and the detected signal SH is at the H level in a case where the medium LP of a large size is a detection target, the right side first sensor 83A senses the medium LP and is at the H level, and the left side second sensor 83B does not sense the medium LP and is at the L level. When the carriage 82 starts to move from the home position, first, the left side second sensor 83B senses the left side first side edge PE1, and the detected signal SB rises from the L level to the H level. Furthermore, when the carriage 82 moves in a time t3 corresponding to the medium width, the right side first sensor 83A senses the right side second side edge PE2, and the detected signal SA falls from the H level to the L level. The number of steps of the electric motor 103 output during the period of the time t3 corresponds to the distance of movement of the carriage 82 during the period, and the distance of movement of the carriage 82 corresponds to the width of the medium LP.

Next, operation of the printing apparatus 11 will be described with reference to FIG. 18 to FIG. 21. The control unit 120 performs a medium side edge detection process illustrated in FIG. 20 when a power supply of the printing apparatus 11 is turned ON. In addition, the control unit 120, in the case of detecting failure of one of the sensors 83A and 83B in the medium side edge detection process illustrated in FIG. 20, performs a medium side edge detection process at the time of failure illustrated in FIG. 21.

First, in Step S11, a sensor failure detection process is performed. The sensor failure detection process is performed when the transport unit 32 does not transport the medium P. Examples of the time when the medium P is not transported include when the power supply of the printing apparatus 11 is turned ON, when the printing apparatus 11 is in a printing standby state of waiting for reception of a print job, and when the printing apparatus 11 returns from a pause mode (sleep mode). In the present example, the light reflective surface 71C is disposed in a region facing the moving paths of the sensors 83A and 83B. Thus, the sensors 83A and 83B face the light reflective surface 71C in any position on the moving paths thereof. For example, with the carriage 82 being in the home position HP, the sensors 83A and 83B emit light and receive reflective light that is formed by reflection of the emitted light by the light reflective surface 71C. The control unit 120 determines failure in a case where the received light intensity from reception of the reflective light formed by reflection of the light from the sensors 83A and 83B by the light reflective surface 71C does not exceed a threshold and where the detected signal of the received light is at the H level indicating the presence of a medium. The failure detection process is performed for each of the two sensors 83A and 83B.

In a case where the light reflective surface 71C exists in only a region facing a part of the moving paths of the sensor 83A and 83B and where the two sensors 83A and 83B are not in a position facing the light reflective surface 71C, the control unit 120 drives and controls the electric motor 103 and arranges the two sensors 83A and 83B to a position facing the light reflective surface 71C. The control unit 120 renders the two sensors 83A and 83B arranged in a position facing the light reflective surface 71C to emit light and thereby performs the failure detection process based on each detected signal.

In Step S12, a determination as to whether or not a sensor fails is performed. In the failure determination, failure is determined if any of the two sensors 83A and 83B fails. If any sensor fails, the process proceeds to Step S13. If no sensor fails, the process proceeds to Step S14.

In Step S13, failure notification is performed. That is, the control unit 120, for example, displays a message indicating failure on the display unit 15 and thereby notifies a user of failure. The failure notification may be performed as notification with light emission or blinking of a light emitting unit such as a light emitting diode, notification with a buzzer or audio, or notification by combining these plural types of notification methods.

In Step S14, a determination as to whether or not a print job including the width information is received is performed. In the printing apparatus 11 of the present example, a print job includes the printing setting information, and one item in the printing setting information includes the width information of a medium (for example, the paper size). That is, the process of Step S14 has the same meaning as a determination as to whether or not a print job is received. In the case of receiving a printing instruction by a method other than a print job, for example, in the case of connecting a memory card not illustrated to the printing apparatus 11 and printing an image selected from the memory card by operating the operation unit 16, the control unit 120 acquires the width information (for example, the paper size) of the medium P selected by the operation unit 16.

In Step S15, a determination as to whether or not all sensors are normal is performed. Specifically, the failure detection unit 143 of the control unit 120 performs the failure detection process of detecting failure of the first and second sensors 83A and 83B and determines whether or not all of the sensors 83A and 83B are normal based on the result of the failure detection process. As the failure detection process, with no medium present before the medium P is fed, if the values of the detected signals SA and SB from the sensors 83A and 83B that are supposed to receive reflective light reflected by the light reflective surface 71C are not equal to a value when there is no medium (for example, the L level) and are equal to a value when a medium is sensed (for example, the H level), those sensors are determined as failing.

If all of the sensors 83A and 83B are normal, the process proceeds to Step S16. The process proceeds to Step S19 in a case where any of the sensors 83A and 83B fails.

In Step S16, a determination as to whether or not the width of a medium is less than or equal to the set width is performed. If the width of the medium P acquired from the width information is less than or equal to the set width, that is, if the medium P is the medium SP of a small size, the control unit 120 proceeds to Step S17. Meanwhile, if the width of the medium P acquired from the width information exceeds the set width, that is, if the medium P is the medium LP of a large size, the process proceeds to Step S18.

In Step S17, a first side edge detection process of detecting both side edges of a medium by using one sensor is performed. The carriage control unit 142 of the control unit 120 drives and controls the electric motor 103 through the motor drive circuit 131 and renders the carriage 82 to move in the width direction X. In the present example in which the electric motor 103 is a stepping motor, the carriage control unit 142 controls the electric motor 103 by specifying the number of steps. The counter 145 is reset when the carriage 82 is in the home position HP and the position sensor 90 senses the detected portion 82A, and performs a counting process of adding or subtracting the number of steps used in control in the advancing direction of the carriage 82. Accordingly, the counter 145 stores the count value corresponding to the positions of the carriage 82 in the width direction X. In the case of the medium SP of a small size such as A4 of which the width of the medium P based on the width information is less than or equal to the set width, the carriage control unit 142 renders the carriage 82 to move from the home position HP to a position A1 illustrated by a double-dot chain line in FIG. 17. During movement of the carriage 82, the detection processing unit 144 detects both side edge positions PE1 and PE2 of the medium SP of a small size by using only one first sensor 83A.

At this point, as illustrated in FIG. 18, the detected signal SH of the position sensor 90, the detected signal SA of the first sensor 83A, and the detected signal SB of the second sensor 83B are input into the control unit 120. The detection processing unit 144 of the control unit 120 monitors the detected signal SA of the first sensor 83A. When the detected signal SA rises from the L level to the H level, the detection processing unit 144 acquires the count value of the counter 145 at that time and calculates the first side edge position PE1 by using the count value and a known first distance (for example, L1/2) in the width direction X from the center position of the carriage width to the first sensor 83A. The calculated first side edge position PE1 is stored on the memory. When the detected signal SA of the first sensor 83A falls from the H level to the L level during movement of the carriage 82, the count value of the counter 145 at that time is acquired. The second side edge position PE2 is calculated by using the count value and the above known first distance, and the calculated second side edge position PE2 is stored on the memory. If both of the two sensors 83A and 83B do not sense the medium SP when the carriage 82 is in the home position HP, using only the first sensor 83A that is positioned on the front side in the advancing direction during movement of the carriage 82 at the time of medium detection allows both side edge positions PE1 and PE2 of the medium P to be detected in a relatively short distance of movement of the carriage 82.

Figure 20:
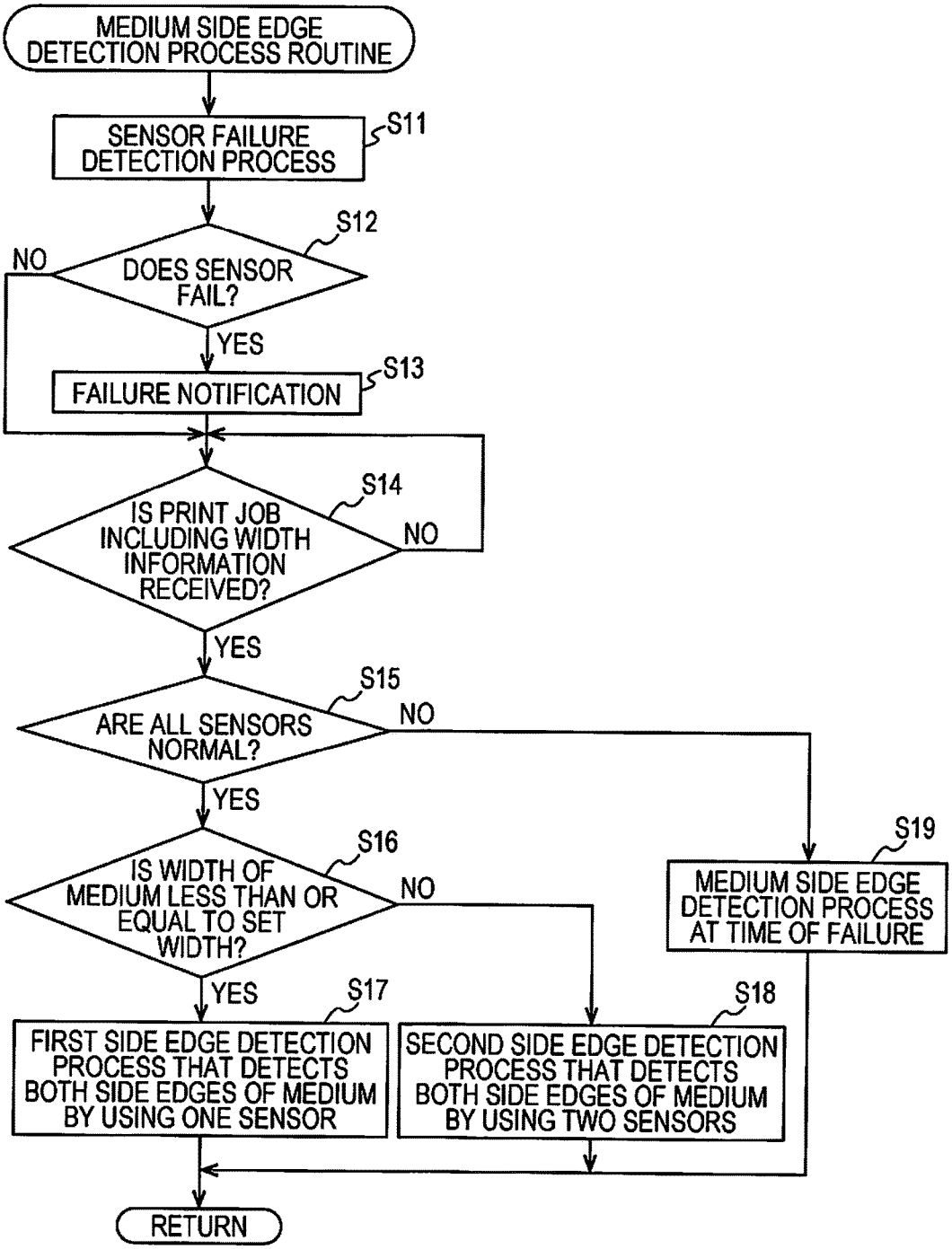
FIG. 20 is a flowchart illustrating a medium side edge detection process routine.

In Step S18 in FIG. 20, a second side edge detection process of detecting both side edges of a medium by using two sensors is performed. The carriage control unit 142 of the control unit 120 drives and controls the electric motor 103 through the motor drive circuit 131 by specifying the number of steps and renders the carriage 82 to move in the width direction X. At this point, the counter 145 counts the positions of the carriage 82 in the width direction X with the origin set to the position when the carriage 82 is in the home position HP. In the case of the medium LP of a large size such as A3 of which the width of the medium P based on the width information exceeds the set width, the carriage control unit 142 renders the carriage 82 to move in the width direction X from the home position HP to, for example, a position A2 illustrated by a double-dot chain line in FIG. 17. During movement of the carriage 82, the detection processing unit 144 detects both side edge positions PE1 and PE2 of the medium LP of a large size in the width direction X by using both of the first and second sensors 83A and 83B.

Specifically, as illustrated in FIG. 19, when the carriage 82 is in the home position HP and the detected signal SH is at the H level, the first sensor 83A senses the medium LP, and the detected signal SA thereof is at the H level. Meanwhile, the detected signal SB of the second sensor 83B that does not sense the medium LP is at the L level. When the carriage 82 starts to move from the home position HP, the detection processing unit 144 first monitors the detected signal SB of the second sensor 83B. When the detected signal SB of the second sensor 83B rises from the L level to the H level, the detection processing unit 144 acquires the count value of the counter 145 at that time and calculates the first side edge position PE1 by using the count value and a known second distance (for example, L1/2) in the width direction X from the center position of the carriage width to the second sensor 83B. The calculated first side edge position PE1 is stored on the memory. When the detected signal SA of the first sensor 83A falls from the H level to the L level during subsequent movement of the carriage 82, the count value of the counter 145 at that time is acquired. The second side edge position PE2 is calculated by using the count value and the above known first distance, and the calculated second side edge position PE2 is stored on the memory. If one of the two sensors 83A and 83B does not sense the medium LP when the carriage 82 is in the home position HP, the first side edge position PE1 is detected by the second sensor 83B that is positioned on the rear side in the advancing direction of the carriage 82 at the time of medium detection, and the second side edge position PE2 is detected by the first sensor 83A that is positioned on the front side in the advancing direction. Thus, both side edge positions PE1 and PE2 of the medium P can be detected in a relatively short distance of movement of the carriage 82.

In Step S19 in FIG. 20, the medium side edge detection process at the time of failure is performed. The medium side edge detection process at the time of failure is performed by the computer of the control unit 120 executing a medium side edge detection process routine at the time of failure illustrated in FIG. 21.

Figure 21:
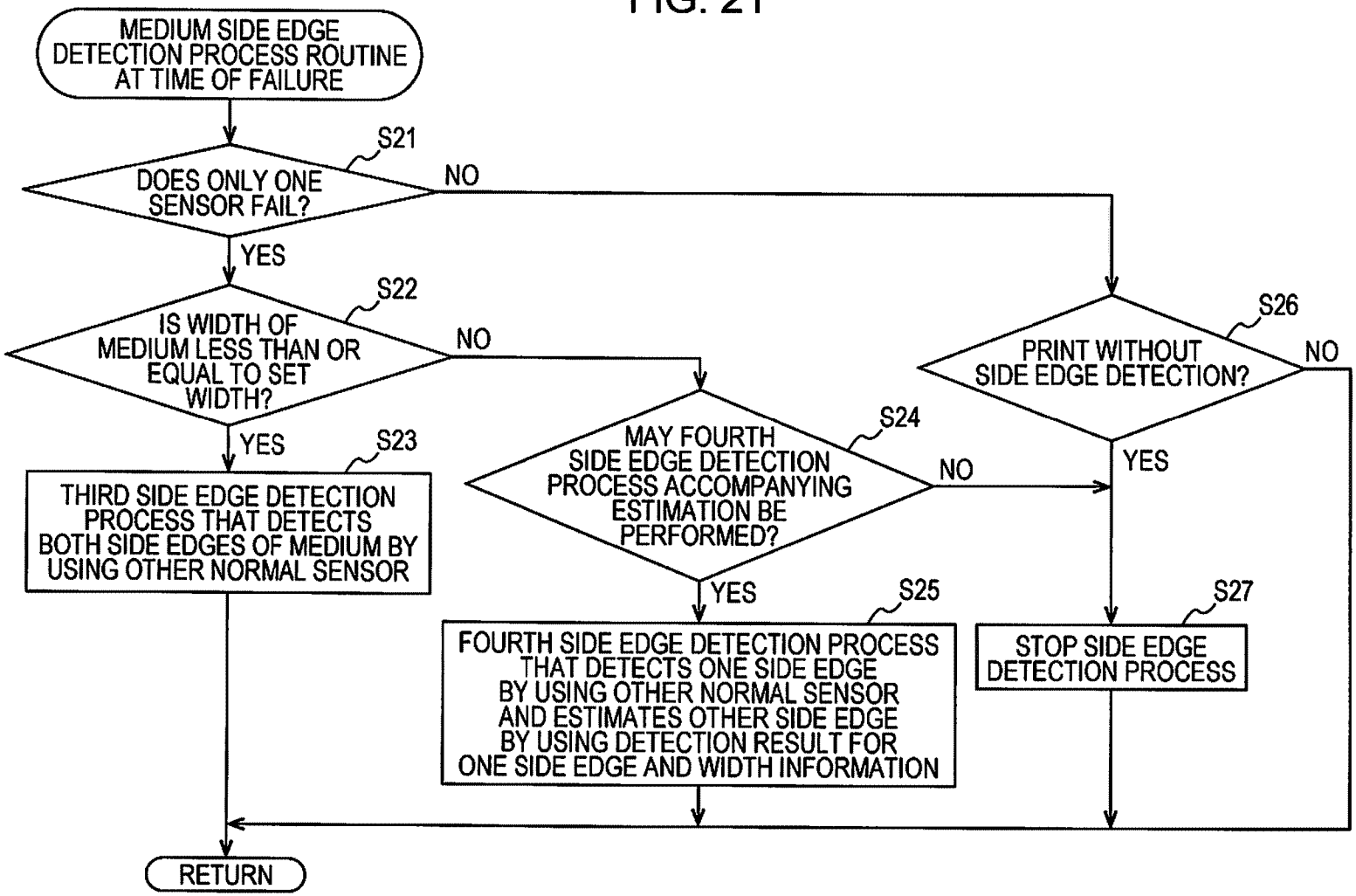
FIG. 21 is a flowchart illustrating a medium side edge detection process routine at the time of failure.

Hereinafter, the medium side edge detection process at the time of failure performed by the control unit 120 will be described with reference to FIG. 21.

First, in Step S21, a determination as to whether or not only one sensor fails is performed. That is, the control unit 120 determines whether or not only one sensor fails by using the detection result of the sensor failure detection process in Step S11 of FIG. 20. If only one sensor fails, the process proceeds to Step S22. If not only one sensor fails, that is, if both of two sensors fail, the process proceeds to Step S26.

In Step S22, a determination as to whether or not the width of a medium is less than or equal to the set width is performed. This determination process is the same as the determination process of Step S16 in FIG. 20 and is performed based on the width information. If the width of the medium P is less than or equal to the set width, the process proceeds to Step S23. Meanwhile, if the width of the medium P is not less than or equal to the set width, that is, if the width of the medium P exceeds the set width, the process proceeds to Step S24.

In Step S23, a third side edge detection process of detecting both side edges of a medium by using the other normal sensor is performed. For example, in a case where the first sensor 83A is normal and the second sensor 83B fails, both side edge positions PE1 and PE2 of the medium P are detected by using the normal first sensor 83A, and the first side edge detection process which is the same as Step S17 in FIG. 19 is performed as the third side edge detection process. Meanwhile, in a case where the first sensor 83A fails and the second sensor 83B is normal, the third side edge detection process of detecting both side edge positions PE1 and PE2 of the medium P by using the normal second sensor 83B is performed. In the case of the latter, the count value of the counter 145 when the detected signal SB from the second sensor 83B rises from the L level to the H level is acquired, the first side edge position PE1 is calculated by using the count value and the above known second distance, and the calculated first side edge position PE1 is stored on the memory. In addition, the count value of the counter 145 when the detected signal SB falls from the H level to the L level is acquired, the second side edge position PE2 is calculated by using the count value and the above known second distance, and the calculated second side edge position PE2 is stored on the memory.

In Step S24, a determination as to whether or not a fourth side edge detection process accompanying estimation may be performed is performed. In the present example, the control unit 120 displays, on the display unit 15, an inquiry message of whether or not the fourth side edge detection process accompanying estimation may be performed, and determines whether or not to perform the fourth side edge detection process based on an operation signal generated by a user operating the operation unit 16 as a response to the inquiry. Alternatively, a user operates the operation unit 16 of the printing apparatus 11 to read preregistered registered information from the memory and determines whether or not to perform the fourth side edge detection process based on the registered information. The control unit 120 proceeds to Step S25 if the fourth side edge detection process is permitted and proceeds to Step S27 if the fourth side edge detection process is not permitted.

In Step S25, the fourth side edge detection process of detecting one side edge by using the other normal sensor and estimating the other side edge by using the detection result for one side edge and the width information is performed. As illustrated in FIG. 17, the movable range in which the carriage 82 can move from the end position E1 on the home position HP side to the end position E2 on the anti-home position AP side is relatively shortened in the printing apparatus 11 of the present example. Thus, the size dimension of the medium detection device 80 in the width direction X and, furthermore, the size dimension of the printing apparatus 11 in the width direction X are small, and this contributes to rendering the printing apparatus 11 compact. However, since the movable range of the carriage 82 is relatively short, both side edges of the medium LP cannot be detected by only the other normal sensor in a case where the medium LP of a large size is a detection target.

Thus, one side edge position is detected by a normal sensor, and the other side edge position that cannot be detected due to failure of the other sensor is estimated by calculation using the side edge position detected by the normal sensor and the width information. Specifically, the control unit 120 detects one side edge by using the other sensor of the first and second sensors 83A and 83B that does not fail. For example, in a case where the first sensor 83A is normal and the second sensor 83B fails, one side edge position PE2 is detected by the first sensor 83A. In addition, in a case where the first sensor 83A fails and the second sensor 83B is normal, one side edge position PE1 is detected by the second sensor 83B. The calculating unit 146 of the detection processing unit 144 calculates the other side edge position by using the detected one side edge position and the width information of the medium P. Given that one side edge position detected by the other sensor is x1 and the medium width is W1, an other side edge position x2 of the medium P is calculated by x2=x1−W1 in a case where the first sensor 83A is normal and by x1+W1 in a case where the second sensor 83B is normal. Both side edge positions PE1 and PE2 of the medium P are acquired by the fourth side edge detection process.

The control unit 120 controls the printing area of the printing head 34 in the width direction X based on both side edge positions PE1 and PE2 of the medium P acquired by the medium side edge detection process. Consequently, printing is performed in an appropriate position range in the width direction X of the medium P. The control unit 120 acquires the width of the medium P from the side edge positions PE1 and PE2 and, in a case where the width is different from the medium width acquired from the width information and exceeds an allowable range, renders the display unit 15 to display a message indicating medium size error.

In Step S26, a determination as to whether or not printing may be performed without side edge detection is performed. In the present example, for example, the control unit 120 renders the display unit 15 to display an inquiry message and inquires a user as to whether or not printing may be performed without detecting a side edge of the medium P. Based on an operation signal from the operation unit 16, when the control unit 120 receives a response indicating that printing is performed without side edge detection (positive determination in S26), the control unit 120 proceeds to Step S27. Meanwhile, when the control unit 120 receives a response indicating that printing is not performed without side edge detection (negative determination in S26), the control unit 120 ends the routine. In the case of the latter, printing is stopped.

In Step S27, the side edge detection process is stopped. The control unit 120 includes a flag for managing whether or not to perform the side edge detection process and writes a value indicating stopping into the flag. In this case, the control unit 120 performs printing based on the print job data PD without performing the side edge detection process.

At this point, the control unit 120 controls the printing area of the printing head 34 based on the medium width acquired from the width information.

In FIG. 20, the processes of Step S24 and Step S25 may be removed, and the fourth side edge detection process accompanying estimation may not be performed. In addition, when a negative determination is made in Step S24, the process may proceed to the determination process of Step S26. Furthermore, the process of Step S26 may be removed, and printing may be stopped in a case where all of the sensors 83A and 83B fail.

According to the first embodiment described in detail heretofore, the following effect can be achieved.

(1) The medium detection device 80 that detects a side edge of the medium P in the width direction X intersecting with the transport direction Y is arranged upstream of the printing head 34 in the transport direction Y of the medium P. The medium detection device 80 includes the carriage 82 capable of moving in the width direction X independently of the printing head 34 in a position upstream of the printing head 34 in the transport direction Y, the two sensors 83A and 83B disposed in different positions in the width direction X in the carriage 82, and the electric motor 103 as one example of a motive power source rendering the carriage 82 to move. The control unit 120 renders the carriage 82 to move by controlling the electric motor 103 and thereby renders the sensors 83A and 83B to detect a side edge of the medium P in the width direction X. Since the two sensors 83A and 83B are arranged in different positions in the width direction X in the carriage 82, using the two sensors 83A and 83B for different uses decreases the amount of movement of the carriage 82 when a side edge of the medium P in the width direction X is detected. Accordingly, both side edges of the medium P in the width direction X can be detected without depending on a printing type like whether the printing head 34 moves or not (for example, a line printing type or a serial printing type). In addition, the size dimension of the printing apparatus 11 in the width direction can be reduced to be comparatively small even though the medium detection device 80 is disposed.

(2) The carriage 82 is disposed to be movable in the width direction X in a position on the opposite side of the transport path 30 of the medium P transported by the transport unit 32 from the printing head 34 side. Thus, the two sensors 83A and 83B configured of optical sensors irradiate the medium P with light from a position on the opposite side of the transport path 30 from the printing head 34 side. Accordingly, ink mist from the printing head 34 is unlikely to cling compared with a case where the two sensors 83A and 83B are arranged on the same side of the medium P as the printing head 34. Thus, a decrease in the accuracy of detection of the sensors 83A and 83B due to staining with ink is easily avoided.

(3) The casing 81 of the medium detection device 80 includes the medium support unit 81B that supports the medium P transported along the transport path 30, and the window portion 88 that can transmit light from the two sensors 83A and 83B is disposed in the medium support unit 81B. Accordingly, since the sensors 83A and 83B are protected by the window portion 88, the sensors 83A and 83B are not directly rendered dirty by dust such as paper dust from the medium P, ink mist from the printing head 34, and the like. Thus, the accuracy of detection of the sensors 83A and 83B can be comparatively highly maintained. In addition, the window portion 88 constitutes a part of the medium support unit 81B, and the distance between the medium P sliding on the upper surface of the window portion 88 and the sensors 83A and 83B can be comparatively short. From this point as well, the accuracy of detection of the sensors 83A and 83B can be highly maintained.

(4) The two window portions 88 are arranged in the width direction X in the medium support unit 81B. Accordingly, compared with a configuration in which one long window portion extending in the area of movement of the sensors 83A and 83B is disposed, a comparatively high strength of the medium support unit 81B can be secured, and the cost of components of the window portion 88 can be reduced to be relatively inexpensive.

(5) A plurality of the window portions 88 is arranged in a position where the two sensors 83A and 83B can detect both side edges of the medium P having the minimum width to the maximum width in the width direction X through different window portions 88. For example, both side edges of the medium P having the minimum width to the maximum width can be continuously detected. For example, even if the medium P of an undefined shape other than the medium P of the defined shape is transported, a side edge of the medium P of the undefined shape can be detected.

(6) Since the electric motor 103 that is one example of the source of motive power of the medium detection device 80 is configured of a stepping motor, an encoder or the like that is required in the case of using a direct current motor (DC motor) for acquiring the position of the carriage 82 is not required. Accordingly, the number of components of the medium detection device 80 can be reduced to be small compared with the case of using a direct current motor. For example, it is easy to realize a small device size for the medium detection device 80.

(7) When the carriage 82 is in the left side end position E1 in the movable range thereof in the case of the medium P having the maximum width, the right side sensor 83A of the two sensors 83A and 83B senses the medium P having the maximum width, and the left side sensor 83B does not sense the medium P having the maximum width. Meanwhile, when the carriage 82 is in a right side end position E2 in the movable range thereof, the left side sensor 83B of the two sensors 83A and 83B senses the medium P having the maximum width, and the right side sensor 83A does not sense the medium P having the maximum width. That is, when the medium P has the maximum width, only the left side sensor 83B is separated to the outside from the medium P in the width direction when the carriage 82 is in the left side end position E1, and only the right side sensor 83A is separated to the outside from the medium P in the width direction X when the carriage 82 is in the right side end position. Thus, since the movable range of the carriage 82 is relatively narrower than the width of the medium P having the maximum width, the size dimension in the width direction X of the printing apparatus 11 in which the medium detection device 80 is disposed is reduced to be comparatively small. In addition, in the case of the medium P having the maximum width, the left side edge PE1 of the medium P is detected by the left side sensor 83B, and the right side edge PE2 of the medium P is detected by the right side sensor 83A, and thereby both side edges PE1 and PE2 of the medium P having the maximum width can be detected.

(8) The left side edge (first side edge PE1) of the medium P is detected by the left side second sensor 83B, and the right side edge (second side edge PE2) of the medium P is detected by the right side first sensor 83A. Accordingly, the distance of movement required for the carriage 82 when both side edges of the medium P in the width direction X are detected is relatively short. Thus, the size dimension of the medium detection device 80 in the width direction X can be short.

For example, the size of the printing apparatus 11 in the width direction being increased due to disposing of the medium detection device 80 can be avoided, and the amount of time required for acquiring the medium information related to the width direction X of the medium P can be reduced to be relatively small.

(9) In a case where the width of the medium P based on the width information acquired by the width information acquiring unit 141 is longer than the set width, the control unit 120 controls the electric motor 103, renders the left side edge (first side edge PE1) of the medium P to be detected by the left side second sensor 83B, and renders the right side edge (second side edge PE2) of the medium P to be detected by the right side first sensor 83A. Accordingly, the distance of movement required for the carriage 82 when both side edges PE1 and PE2 of the medium P are detected can be relatively short. Accordingly, the size dimension of the medium detection device 80 in the width direction can be relatively small, and the amount of time required for acquiring medium information can be reduced to be relatively small.

(10) The guide member 71 as one example of a medium guide member is arranged in a position where the sensors 83A and 83B configured of light reflective type sensors face the window portion 88 transmitting light at the time of detection with the transport path 30 interposed therebetween, and the part of the guide member 71 facing the moving paths of the sensors 83A and 83B is configured as a light reflective surface. Accordingly, since a member dedicated for a light reflective surface is not required to be separately disposed, the medium guiding structure of the transport unit 32 that is upstream of the printing head 34 in the transport direction Y can be configured to be comparatively compact.

(11) Since the guide member 71 is made of metal, the light reflective surface 71C can be comparatively simply formed if the part of the guide member 71 facing the moving paths of the sensors 83A and 83B is, for example, polished.

(12) When the transport unit 32 does not transport the medium P, the control unit 120 monitors the detected signals SA and SB of the sensors 83A and 83B. If a sensor receives reflective light from the light reflective surface 71C, the control unit 120 regards the sensor as being normal. If a sensor does not receive reflective light from the light reflective surface 71C, the control unit 120 regards the sensor as failing. Accordingly, a problem that wrong medium information is acquired, such as erroneous detection of a side edge position based on the detected signal of a failing sensor, can be avoided to the greatest possible extent.

(13) The control unit 120, in a case where one of the two sensors 83A and 83B fails, detects both side edges PE1 and PE2 of the medium P by using the other sensor. Accordingly, even if one sensor fails, the medium information required can be acquired by detecting both side edges PE1 and PE2 of the medium P.

Particularly, even in a case where a comparatively short movable range in which both side edges PE1 and PE2 cannot be detected by only one sensor when the medium P has a large size is set for the carriage 82, the medium information required can be acquired for the medium SP of a small size having a width less than or equal to the set width by detecting both side edges PE1 and PE2 of the medium SP by using the other sensor that does not fail.

(14) The control unit 120, if the width of the medium P is greater than the set width in a case where one of the two sensors 83A and 83B fails, detects one side edge of both side edges PE1 and PE2 of the medium P by using the other sensor, and the calculating unit 146 estimates the other side edge position by calculation based on the result of detection of one side edge and the width information. Accordingly, even for the medium LP having a width that is great to the extent that both side edges cannot be detected by the other sensor when one sensor fails, the medium information including both side edge positions PE1 and PE2 of the medium LP can be acquired.

(15) The printing apparatus 11 includes the transport path 30 transporting the medium P from the cassette 21 and the feed tray 22 as one example of a medium mount unit along a path passing through a position where the printing head 34 can perform printing, and includes the third feed path 93 (one example of a double-sided printing path) that inverts the medium P after performing printing on one side thereof through the transport path 30 by the printing head 34 and returns the medium P to a position midway of the transport path 30.

The medium detection device 80 that can detect both side edges PE1 and PE2 of the medium P by reading the medium P in the width direction X is arranged in a position upstream of the printing head 34 in the transport direction Y of the medium P so that the read position of the medium detection device 80 is positioned upstream in the transport direction Y of the second path joint portion J2 (one example of a joint portion) in which the transport path 30 and the third feed path 93 are joined. Accordingly, the size dimension of the printing apparatus 11 in the transport direction Y can be comparatively small even though the medium detection device 80 is disposed. For example, when a configuration in which the medium P that is refed through the inversion feed path 56 after printing is performed on one side thereof is read by the medium detection device is employed, the joint portion is required to be arranged to be shifted upstream of the read position of the medium detection device in the transport direction Y. Accordingly, the part of the transport path 30 and the inversion feed path 56 that is positioned upstream of the joint portion 76 in the transport direction is required to be shifted upstream in the transport direction Y. In this case, the size dimension of the printing apparatus 11 in the transport direction Y is relatively increased. Regarding this point, the medium P after printing is performed on one side thereof is not read, and the joint portion 76 is arranged downstream of the read position in the transport direction Y. Thus, the part of the transport path 30 and the inversion feed path 56 that is positioned upstream (rear side) of the joint portion 76 in the transport direction Y can be arranged downstream to the greatest possible extent. Consequently, both side edges PE1 and PE2 of the medium P in the width direction X can be detected without depending on a printing type like whether the printing head 34 is a moving type or a fixed type, and the size dimension of the printing apparatus 11 in the transport direction Y can be reduced to be comparatively small.

(16) The medium detection device 80 has a long shape in the width direction X in which the carriage 82 can move with the electric motor 103 as the source of motive power within a moving range in which the sensors 83A and 83B can detect both side edges of the medium P having the maximum width in the width direction X. That is, even if the medium detection device 80 that is slightly longer than the width of the medium P having the maximum width is disposed in the printing apparatus 11 in a direction in which the longitudinal direction of the medium detection device 80 matches the width direction X, the size dimension of the printing apparatus 11 in the transport direction Y can be reduced to be comparatively small by designing a space for arrangement of the medium detection device 80 in such a manner that the second path joint portion J2 is positioned downstream of the read position in the transport direction Y.

(17) The printing apparatus 11 can detect the side edges PE1 and PE2 of the medium P fed from both of the cassette 21 and the feed tray 22 by using the medium detection device 80, and the medium detection device 80 can be disposed while the size of the printing apparatus 11 in the transport direction Y is rendered small.

(18) The read position of the medium detection device 80 is positioned downstream of the first joint portion 75 in which the two feed paths 45 and 48 feeding the medium P from the cassette 21 and the feed tray 22 in the transport direction Y are joined, and upstream of the second path joint portion J2. Accordingly, the medium P that is fed from any of the cassette 21 and the feed tray 22 is read in the read position of the medium detection device 80, and both side edges PE1 and PE2 thereof can be detected. Thus, printing can be performed in an appropriate position in the width direction X on the medium P that is fed from any of the cassette 21 and the feed tray 22.

(19) Particularly, the read position is positioned downstream of the first path joint portion J1 and upstream of the second path joint portion J2 in the transport direction Y. According to this configuration, the distance between the sensors 83A and 83B and the medium P can be maintained approximately constantly, and thus a higher side edge detection accuracy can be secured.

Furthermore, the read position is positioned downstream of the first path joint portion J1 and upstream of the second joint portion 76 in the transport direction Y. According to this configuration, the sensing area of the sensors 83A and 83B with respect to the medium P that is refed through the inversion feed path 56 after printing is performed on one side thereof is protected by the guide member 71, and thus a decrease in the side edge detection accuracy due to staining with ink can be prevented. For example, since the ink of printing performed on one side of the refed medium P is unlikely to cling to the window portion 88, the side edge detection accuracy for the medium P can be maintained highly even in a configuration in which the sensors 83A and 83B reads the medium P through the window portion 88.

(20) The cover 23 to which the first feed unit 41 as one example of a feed mechanism feeding the medium P mounted in the feed tray 22 and the guide member 71 including a part of the medium guide surfaces 71A and 71B forming the second joint portion 76 are attached is disposed to be openable and closable with respect to the apparatus main body 20 in the printing apparatus 11. Thus, when the cover 23 is opened, the first feed unit 41 and the guide member 71 are separated from the apparatus main body 20 along with the cover 23, and a part of the medium detection device 80 is exposed. Consequently, maintenance and the like are easily performed for the medium detection device 80, and the medium detection device 80 can be comparatively easily detached in a case where the medium detection device 80 is required to be detached for maintenance or replacement.

The above embodiment can be modified in the following forms.

The first side edge and the second side edge may be detected by different sensors even in the case of a medium of a small size of which the width based on the width information is less than or equal to the set width. In addition, even in the case of a medium of a large size of which the width based on the width information is longer than the set width, the first side edge and the second side edge may be detected by the same sensor by slightly increasing the distance of movement of the carriage.

In a case where one of two sensors fails and in the case of a medium of which the medium width is longer than the set width, a message may be displayed on the display unit to inquire a user as to whether or not an estimation process of detecting one side edge of the first side edge and the second side edge by the other non-failing sensor and estimating the other side edge by calculation may be performed. For this inquiry, the inquiry may be performed by audio instead of or in addition to display of a message.

While the medium detection device 80 is arranged on the lower side of the transport path 30, the medium detection device 80 may be arranged on the upper side of the transport path 30. Even in this configuration, a side edge of the medium P can be detected by reading the medium P downwards by the two sensors 83, and arranging the medium detection device 80 in a position in which the read position thereof is upstream of the second path joint portion J2 in the transport direction Y can relatively decrease the size dimension of the printing apparatus 11 in the transport direction Y and render the size thereof small.

The medium information acquired by the sensor 83 detecting a side edge of the medium is preferably at least one of, one side edge position PE1 or PE2 of the medium P in the width direction, both of the side edge positions PE1 and PE2, the medium width (includes the medium size defined from the medium width), and the printing area in the width direction X. For example, the medium information may be only one of, one side edge position, both side edge positions, the medium width, and the printing area. In addition, the content of the medium information acquired from the result of side edge detection may be different according to a printing mode, and there may exist a printing mode in which the side edge detection process is not performed. In the case of detecting only one side edge, the carriage 82 is required to be capable of moving in a moving range in which both side edges of a medium having the maximum width can be detected, provided that one side edge of the medium is detected in a certain printing mode and the other side edge of the medium is detected in another printing mode.

The sensors 83A and 83B may sense at least one of the leading edge and the trailing edge of the medium P in the transport direction Y in addition to a side edge of the medium P. For example, before the medium P is fed to the read position, the carriage 82 is rendered to move from the home position HP, and the sensor 83 is rendered to wait in a position where the leading edge of the medium P in the transport direction Y can be detected. When the medium P is fed, the leading edge thereof is sensed.

After the leading edge is sensed, the carriage is rendered to move to one side (for example, the right side) in the width direction X to sense one side edge, and next the carriage is rendered to move to the other side (for example, the left side) in the width direction X to sense the other side edge. For example, the control unit 120 may control the timing of starting a predetermined operation such as the unskewing operation for the medium based on leading edge sensing information acquired by sensing the leading edge of the medium P. In this case, for example, the sensor 79 can be removed. In addition, the control unit 120 may recognize the position of the medium P in the transport direction Y (transport position) based on the leading edge sensing information and control the timing of starting printing by the printing head 34.

In a case where the sensor 83 is configured of an optical sensor, the optical sensor is not limited to a light reflective type and may be a light transmissive type. For example, an illuminant that can move along with the sensor 83 or an illuminant of a line shape that can be turned on in the range across the moving range of the sensor may be arranged in a position facing the medium detection device 80 with the transport path interposed therebetween, and a side edge of the medium may be detected by switching between a light reception state where light from the illuminant is received and a light non-reception state where light is blocked by the medium and cannot be received.

The sensor 83 may be a contact type sensor instead of an optical sensor. Even if the sensor 83 is a contact type sensor, a side edge of the medium can be detected.

The source of motive power of the medium detection device 80 may be configured of a direct current motor (DC motor) instead of a stepping motor. In the case of a DC motor, for example, a linear encoder or a rotary encoder that can output pulse signals of which the number is proportional to the distance of movement of the carriage 82, and a counter that can count a value indicating the position of the carriage 82 by counting pulse edges of the pulse signals output by the encoder may be disposed. The control unit may acquire a side edge position that is detected by the sensors 83A and 83B based on the count value of the counter.

One window portion may be arranged in a region corresponding to the moving path of a sensor instead of arranging the window portion 88 in plural numbers in the width direction X. In addition, the number of the window portions 88 arranged in the width direction X is not limited to two and may be three or more such as three or four. In this case, a plurality of window portions is preferably arranged in a position where both side edges of a plurality of types of the media P having different widths can be detected. For example, a plurality of window portions is preferably arranged in a position in which the position and the width center (center line) of the medium P transported are symmetric about the width direction X.

The inversion feed path 56 (or the third feed path 93) may be an inversion path that joins a joint portion via the opposite side (lower side) of the transport path 30 from the printing head 34 side, instead of being an inversion path that joins a joint portion via the printing head 34 side (upper side) of the transport path 30.

The movable distance of the carriage 82 may be extended by a length in which both side edges PE1 and PE2 of the medium P having the maximum width can be detected by only one sensor of two sensors, and the number of sensors used in accordance with the width of the medium P may not be switched. In this case, a process of comparing the width based on the width information with the set width can be removed. In addition, both side edges of a medium can be detected by only one sensor, and at the time of failure, both side edges of a medium can be detected by only the other sensor.

The medium detection device 80 may be arranged in a position where the read position thereof is upstream of the second path joint portion J2 in the transport direction Y and downstream of the second joint portion 76 in the transport direction Y. In this configuration as well, the medium detection device 80 in the read position is separated from the third feed path 93 along which the medium P is refed after printing is performed on one side thereof. Thus, ink of printing performed on one side is unlikely to cling to the window portion 88. Accordingly, a decrease in the side edge detection accuracy due to this type of ink staining is easily prevented.

The medium detection device 80 may be arranged in a position where the read position thereof is upstream of the first path joint portion J1 in the transport direction Y and downstream of the first joint portion 75 in the transport direction Y. In this configuration as well, the medium P that is fed through any of the two feed paths 45 and 48 is read by one common medium detection device 80, and a side edge thereof can be detected by the medium detection device 80.

In this case, the different feed paths 91 and 92 of a medium comparatively closely pass through the joint location in the first joint portion 75. Thus, if the sensor 83 that has a comparatively long detectable distance is selected, required side edge detection accuracy can be secured.

The medium detection device 80 may be arranged in a position where the read position thereof is upstream of the first joint portion 75 in the transport direction Y. In this case, if the medium detection device 80 is arranged for each of the plurality of feed paths 91 and 92, a side edge of each medium P passing through the different feed paths 91 and 92 can be detected.

In addition, the medium detection device 80 may detect a side edge of only a medium that is fed along one feed path of the plurality of feed paths 91 and 92.

The medium detection device 80 may be arranged in a position where the read position thereof is downstream of the second path joint portion J2 in the transport direction Y. For example, the medium detection device 80 may be arranged downstream of the transport roller pair 46 in the transport direction Y and upstream of the most upstream nozzle of the printing head 34 in the transport direction Y. Furthermore, the medium detection device 80 may be arranged in a position where the medium P after printing can be read. In addition, a plurality of the medium detection device 80 may be disposed in such a manner that a side edge of the medium P can be detected at a plurality of locations on the transport path thereof.

Only a part of the first feed unit 41 may be disposed in the cover 23, only a part of the second feed unit 42 may be disposed in the cover 23, or a part of the first feed unit 41 and a part of the second feed unit may be disposed in the cover 23. In addition, the cover may not include the feed tray 22 as one example of a medium mount unit.

The medium mount unit may be only one of the cassette 21 and the feed tray 22. In addition, the cassette 21 is not necessarily in plural numbers, and only one cassette 21 may be disposed. Furthermore, the number of feed trays is not necessarily one, and the feed tray may be disposed in plural numbers.

The printing apparatus is not limited to a line printing type printing apparatus (line printer) or a serial printing type printing apparatus (serial printer) and may be a lateral printing type printing apparatus (lateral printer) in which the carriage can move in two directions of a main-scanning direction and a sub-scanning direction.

If the invention is applied to this type of serial printer or lateral printer, the size dimensions of the printing apparatus in the width direction X and the transport direction Y can be comparatively decreased in the case of disposing the medium detection device.

Each functional unit built in the control unit is not necessarily realized by software by the computer executing a program and may be realized by hardware by an electronic circuit such as a field-programmable gate array (FPGA) or an application-specific IC (ASIC) or may be realized by cooperation of software and hardware.

The medium is not limited to paper and may be configured of a film or sheet made of resin, a composite film of resin and metal (laminated film), fabric, non-woven fabric, metal foil, a ceramic sheet, or the like.

The printing apparatus is not limited to a multifunction peripheral and may be a printer that includes a printer unit and does not include a scanner unit.

The printing apparatus is not limited to an ink jet type printer and may be a dot impact type printer, a thermal transfer type printer, or an electrophotographic printer.

The printing apparatus is not limited to a printing apparatus performing printing on a medium such as paper and may be a 3D printer that discharges liquid resin drops to a medium configured of a base and the like of a component to form a three-dimensional object. In this type of printing apparatus as well, the size dimension of the apparatus main body can be comparatively decreased, and a high accuracy three-dimensional object can be formed on a medium such as a base.

The entire discovery of Japanese Patent Application No. 2016-026142, filed Feb. 15, 2016 is expressly incorporated by reference herein.

What is claimed is:

1. A printing apparatus comprising:

a transport portion that transports a medium;

a printing head that performs printing on the medium;

a medium detection unit that is arranged upstream of the printing head in a transport direction of the medium and detects a side edge of the medium in a width direction intersecting with the transport direction, the medium detection unit including a carriage that is movable in the width direction in a position upstream of the printing head in the transport direction, and two sensors that are disposed in different positions in the width direction in the carriage; and a control unit that controls the transport portion, the printing head, and the medium detection unit, and acquires width information of the medium, the control unit rendering at least one of the sensors to detect a side edge of the medium in the width direction by controlling the medium detection unit to move the carriage, the control unit controlling only one sensor of the sensors to detect side edges of the medium in response to acquiring the width information on the width of the medium that is less than or equal to a set width, the control unit controlling the two sensors to detect the side edges of the medium in response to acquiring the width information on the width of the medium that exceeds the set width.

2. The printing apparatus according to claim 1, wherein the carriage is disposed to be movable in the width direction in a position on the opposite side of a transport path of the medium transported by the transport portion from the printing head side, and the two sensors are optical sensors that irradiate the medium with light from a position on the opposite side of the transport path from the printing head side.

3. The printing apparatus according to claim 2, wherein the medium detection unit includes a casing that accommodates the carriage and the two sensors, the casing includes a medium support unit that supports the medium transported along the transport path, and the medium support unit includes a window portion that is capable of transmitting light from the two sensors.

4. The printing apparatus according to claim 3, wherein the window portion is disposed in the medium support unit in plural numbers in the width direction.

5. The printing apparatus according to claim 4, wherein a plurality of the window portions is disposed in a position where the two sensors are capable of detecting both side edges of the medium having the minimum width to the maximum width through the different window portions.

6. The printing apparatus according to claim 5, wherein a source of motive power of the medium detection unit is a stepping motor.

7. The printing apparatus according to claim 1, wherein given that the width direction in which the carriage is movable is a left-right direction, in a case where the medium is a medium having the maximum width, when the carriage is in a left side end position in a movable range, the right side sensor of the two sensors senses the medium having the maximum width, and the left side sensor does not sense the medium having the maximum width, and meanwhile, when the carriage is in a right side end position in the movable range, the left side sensor of the two sensors senses the medium having the maximum width, and the right side sensor does not sense the medium having the maximum width.

8. The printing apparatus according to claim 7, wherein in response to acquiring the width information on the width of the medium that exceeds the set width, the control unit controls the medium detection unit in such a manner that the left side sensor detects the left side edge of the medium and that the right side sensor detects the right side edge of the medium.

9. The printing apparatus according to claim 8, wherein the control unit, when the transport portion does not transport the medium, regards, as being normal, a sensor of the left side and right side sensors, which has a detected signal with a detected value when the medium is not present, and regards, as failing, a sensor of the left side and right side sensors, which has a detected signal with a detected value when the medium is present.

10. The printing apparatus according to claim 9, wherein in response to regarding one of the left side and right side sensors as failing, the control unit detects both side edges of the medium by using the other sensor.

11. The printing apparatus according to claim 10, wherein in response to regarding the one of the left side and right side sensors as failing, the control unit detects the both side edges of the medium by using the other sensor if the width of the medium based on the width information is less than or equal to the set width.

12. The printing apparatus according to claim 11, wherein the control unit, in response to regarding one sensor of the left side and right side sensors as failing, if the width of the medium based on the width information is greater than the set width, detects one side edge of both side edges of the medium by using the other sensor and estimates the position of the other side edge based on the result of detection of the one side edge and the width information.

13. The printing apparatus according to claim 7, wherein the left side and right side sensors are light reflective type sensors, and a medium guide member that guides the medium along the transport path is arranged in a position facing a moving path of the left side and right side sensors with the transport path of the medium transported by the transport portion interposed between the position and the moving path of the left side and right side sensors, and a part of the medium guide member facing the moving path of the left side and right side sensors is a reflective surface that reflects light.

14. A printing apparatus comprising:

a transport portion that transports a medium;

a printing head that performs printing on the medium;

a medium detection unit that is arranged upstream of the printing head in a transport direction of the medium and detects a side edge of the medium in a width direction intersecting with the transport direction, the medium detection unit including a carriage that is movable in the width direction in a position upstream of the printing head in the transport direction, the carriage being disposed to be movable in the width direction in a position on the opposite side of a transport path of the medium transported by the transport portion from the printing head side, and two sensors that are disposed in different positions in the width direction in the carriage, the two sensors being optical sensors that irradiate the medium with light from a position on the opposite side of the transport path from the printing head side; and a control unit that controls the transport portion, the printing head, and the medium detection unit, the control unit rendering at least one of the sensors to detect a side edge of the medium in the width direction by controlling the medium detection unit to move the carriage, the medium detection unit further including a casing that accommodates the carriage and the sensor, the casing including a medium support unit that supports the medium transported along the transport path, and the medium support unit including a window portion that is capable of transmitting the light from the two sensors, and the two sensors detecting the side edge of the medium through the window portion that is a transparent member that is capable of transmitting the light and that extends in the width direction.

* * * * *